US008973336B2

(12) United States Patent
Edwards et al.

(10) Patent No.: US 8,973,336 B2
(45) Date of Patent: Mar. 10, 2015

(54) SYSTEMS AND METHODS FOR PROVIDING ROUNDED VAULT FORMING STRUCTURES

(75) Inventors: Matthew Edwards, Enoch, UT (US); Ronald K. Kraft, Danville, CA (US)

(73) Assignee: Southern Utah University, Cedar City, UT (US)

( * ) Notice: Subject to any disclaimer, the term of this patent is extended or adjusted under 35 U.S.C. 154(b) by 0 days.

(21) Appl. No.: 13/590,170

(22) Filed: Aug. 20, 2012

(65) Prior Publication Data

US 2012/0311941 A1 Dec. 13, 2012

Related U.S. Application Data

(63) Continuation-in-part of application No. 13/117,090, filed on May 26, 2011, now abandoned.

(60) Provisional application No. 61/525,113, filed on Aug. 18, 2011.

(51) Int. Cl.

| | |
|---|---|
| ***E04B 1/00*** | (2006.01) |
| ***E04G 21/00*** | (2006.01) |
| ***E04G 23/00*** | (2006.01) |
| ***E04H 1/02*** | (2006.01) |
| ***E04B 7/08*** | (2006.01) |
| ***E04C 5/16*** | (2006.01) |
| ***E04H 1/00*** | (2006.01) |
| ***E04G 11/04*** | (2006.01) |

(52) U.S. Cl.

CPC .. *E04H 1/02* (2013.01); *E04B 7/08* (2013.01); *E04C 5/168* (2013.01); *E04H 1/005* (2013.01); *E04G 11/04* (2013.01)

USPC ..... 52/745.07; 52/2.15; 52/81.6; 52/80.1; 52/79.4; 52/236.1

(58) Field of Classification Search

CPC ..... E04C 5/168; E04G 11/04; E04H 1/005

USPC ..... 52/745.07, 81.1, 292, 82, 79.4, 79.8, 52/88, 80.2, 236.1, 236.2, 79.7, 126.1, 52/126.3, 741.3, 81.6, 2.15, 80.1

See application file for complete search history.

(56) References Cited

U.S. PATENT DOCUMENTS

| | | | | | |
|---|---|---|---|---|---|
| 2,324,554 | A | * | 7/1943 | Billner | 264/31 |
| 2,335,300 | A | * | 11/1943 | Neff | 264/32 |
| 3,172,392 | A | * | 3/1965 | Schultz | 119/482 |
| 3,225,413 | A | * | 12/1965 | Bird et al. | 425/438 |
| 3,619,432 | A | * | 11/1971 | Harrington | 52/2.15 |
| 3,763,608 | A | * | 10/1973 | Chamlee | 52/81.4 |
| 3,894,367 | A | * | 7/1975 | Yacoboni | 52/81.2 |
| 3,924,363 | A | * | 12/1975 | Candle | 52/2.19 |
| 3,932,969 | A | | 1/1976 | Matras | |
| 3,999,337 | A | * | 12/1976 | Tomassetti et al. | 52/82 |
| 4,041,671 | A | | 8/1977 | Nicholson | |
| 4,063,566 | A | * | 12/1977 | Millerioux | 135/97 |
| 4,077,177 | A | * | 3/1978 | Boothroyd et al. | 52/745.07 |
| 4,094,110 | A | | 6/1978 | Dickens et al. | |

(Continued)

*Primary Examiner* — Chi Q Nguyen

(74) *Attorney, Agent, or Firm* — David B. Tingey; Bryant J. Keller; Kirton McConkie

(57) ABSTRACT

Rounded vault forming structures and the systems and methods for making the same are disclosed. Such structures include a monolithic building having one or more arches, one or more integrated hip structures, and a non-circular outer circumferential shaped base. At least some of the structures result in zero to extremely low amounts of waste material from building such structures.

19 Claims, 45 Drawing Sheets

(56) References Cited

U.S. PATENT DOCUMENTS

| | | | | | |
|---|---|---|---|---|---|
| 4,144,680 | A | * | 3/1979 | Kelly | 52/81.4 |
| 4,155,967 | A | * | 5/1979 | South et al. | 264/32 |
| 4,680,901 | A | * | 7/1987 | Armitage | 52/81.4 |
| 4,686,804 | A | * | 8/1987 | Smith | 52/169.6 |
| 4,776,145 | A | * | 10/1988 | Dykmans | 52/745.07 |
| 4,838,292 | A | * | 6/1989 | Allen | 135/100 |
| 4,927,696 | A | * | 5/1990 | Berg | 428/195.1 |
| 5,094,044 | A | * | 3/1992 | Dykmans | 52/80.1 |
| 5,140,790 | A | * | 8/1992 | Modglin et al. | 52/81.4 |
| 5,170,599 | A | * | 12/1992 | Knight | 52/91.1 |
| 5,313,763 | A | * | 5/1994 | Oram | 52/80.2 |
| 5,680,731 | A | * | 10/1997 | Guy | 52/126.1 |
| 5,724,775 | A | * | 3/1998 | Zobel et al. | 52/82 |
| 6,484,454 | B1 | * | 11/2002 | Everhart | 52/79.4 |
| 6,840,013 | B2 | * | 1/2005 | South | 52/2.15 |
| 2012/0297698 | A1 | | 11/2012 | Edwards | |

* cited by examiner

SYSTEMS AND METHODS FOR PROVIDING ROUNDED VAULT FORMING STRUCTURES

RELATED APPLICATIONS

This application is a continuation-in-part of U.S. patent application Ser. No. 13/117,090, filed May 26, 2011, and entitled SYSTEMS AND METHODS FOR PROVIDING ROUNDED VAULT FORMING BUILDINGS. This application also claims the benefit of U.S. Provisional Patent Application No. 61/525,113, filed Aug. 18, 2011, and entitled SYSTEMS AND METHODS FOR PROVIDING ROUNDED VAULT FORMING STRUCTURES. Both of the applications are incorporated herein by reference in their entirety.

BACKGROUND OF THE INVENTION

1. Field of the Invention

The present invention relates to systems and methods for providing rounded vault forming structures. In particular, the present invention relates to systems and methods for providing a level foundation and building a monolithic building thereon, the monolithic building having one or more arches, one or more integrated hip structures, and a non-circular outer circumferential shaped base.

2. Background and Related Art

A monolithic dome is a dome-like structure which is cast in a one-piece form. As compared to a traditional home style, monolithic buildings are relatively straight-forward in their construction, exceptionally strong and comparatively inexpensive to construct. As such, monolithic dome homes are desirable in areas prone to natural disasters as well as financially poor areas of the world.

The process for providing a monolithic dome typically begins with the formation of a round foundation which approximates the general outer circumferential shape of the dome's base. A dome form, such as an air form (i.e.: an air bladder) is generally secured to the cured foundation and inflated to provide a three-dimensional form. A lattice of rebar is provided to the dome form and then covered with a cementitious material, such as cement, concrete, plaster, stucco, Air Krete® or fiber-reinforced cement. Once the cementitious material is cured, the form is deflated or otherwise removed from the structure thereby revealing the surface of the structure. The resultant dome structure provides a large interior dome-shaped living space that is generally energy efficient.

In some parts of the world, the exterior dome shape of the building is considered aesthetically undesirable, most especially when located in a neighborhood consisting of traditional rectangular-shaped homes. For this reason, most home builders will forgo the financial, natural disaster resistant properties, environmental and energy savings of building a monolithic dome home, in favor of a home build with a more traditional shape and structure.

Thus, while techniques currently exist for providing monolithic dome structures, challenges still exist. Accordingly, it would be an improvement in the art to augment or even replace current techniques with other techniques.

SUMMARY OF THE INVENTION

The present invention relates to systems and methods for providing rounded vault forming structures based on bi-secting arches. In particular, the present invention relates to systems and methods for providing a level foundation and building a monolithic building thereon, the monolithic building having one or more arches, one or more integrated hip structures, and a non-circular outer circumferential shaped base.

In some implementations of the present invention, a method for providing a monolithic building includes steps for coupling an air form to a surface of a foundation, providing a hip form to a surface of the air form such that the air form supports the hip form, and applying a building material to an outer surface of the air form and an outer surface of the hip form. The method further includes a step for providing a foundation on which the vaulted building is constructed. In some implementations, a laser mounting device is used to level and square the foundation forms.

In some implementations of the present invention, the hip forms comprise a plurality of modular sections that are interconnected to form a desired form shape. The hip forms include an inner surface, an outer surface, a base surface and an interface surface, wherein the base surface abuts the foundation, and the interface surface of the hip form abuts the outer surface of the air form to provide a monolithic building form. In some implementations, a modular form securing system is provided having a channel for receiving a portion of a base surface of an air form, the modular form securing system further having a fastener whereby to secure the modular form securing system to the foundation, wherein the base surface of the air form is secured to the foundation via the modular form securing system.

In some implementations of the present invention, a set of color coded construction plans and color coded measuring tape or other device is provided which uses colors, symbols, and codes to provide instructions for constructing the monolithic building of the present invention.

Further, in some implementations of the present invention, a monolithic vaulted structure device is provided which includes an arch structured shell having an inner surface, an outer surface and an interior volume, the device further having an integrated hip structure having an interior volume in fluid communication with the interior volume of the dome shell. In some implementations, the integrated hip structure is a structural feature of the device which is at least one of a dormer, a garage, a nook, an entryway, a room, or other structure having an appearance that is different from the arch structured shell, yet is itself constructed monolithically.

BRIEF DESCRIPTION OF THE DRAWINGS

In order to set forth the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

The present invention relates to systems and methods for providing a monolithic building. In particular, the present invention relates to systems and methods for providing a level foundation and building a monolithic building thereon, the monolithic building having a plurality of intersecting arches, one or more integrated hip structures, and a non-circular outer circumferential shaped base With reference to FIGS. 1A-1D, a monolithic building 10 is shown. In some embodiments, monolithic building 10 comprises a unitary structure having a centrally located arch structured or vault shaped apex (or simply a vault or cupola) 12 and a plurality of integrated hip structures 20. As used herein, the term "monolithic" is understood to mean a single, integrated structure that is formed of a single unitary material and structure. The monolithic buildings and structures of embodiments of the present invention are single, unitary dome structures having various appendages or hip structures 20 that are formed concomitantly during the construction process. Thus in some embodiments, monolithic building 10 comprises two or more intersecting arches 14 forming a vault-shaped apex 12, wherein portions of the monolithic building 10 are integrated hip structures 20.

In some embodiments, hip structures 20 comprise a dormer, such as a window dormer. In other embodiments, hip structures 20 comprise at least one of a garage, a nook, an entryway, a room, or other structure having an appearance that is different from the arch structured shell, yet is itself constructed monolithically. Monolithic building 10 further comprises doors and windows to provide access to the interior of the building. In some embodiments, openings for doors, windows and/or any other needed opening are formed during the process of forming the building. For example, material is used to mask where the designer does not want concrete—such as where the window(s) or door(s) are to be located. Utilization of the masking material results in the desired void(s) in the building.

In other embodiments, access holes are cut into building 10 following construction of the building 10 to allow installation of doors and windows. In some embodiments, the exterior of building 10 is decorated with brick, stucco, siding or other ornamental exterior covering materials to provide a desired aesthetic look. In some embodiments, a cementitious outer construction material of building 10 is stamped, painted and/or stained to resemble a desired ornamental exterior covering material. Thus, the exterior of building 10 may be modified and decorated to match or closely resemble a desired traditional home style.

Figure 1A:
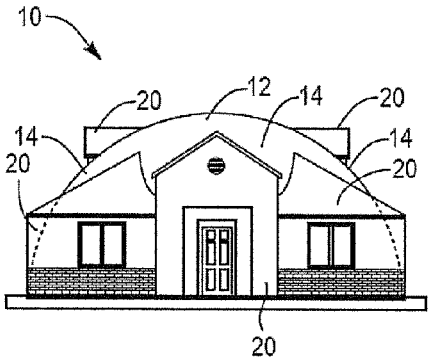
FIG. 1 as shown in parts A-E provides perspective views of monolithic buildings having a plurality of integrated hip structures in accordance with representative embodiments of the present invention.
Figure 1B:
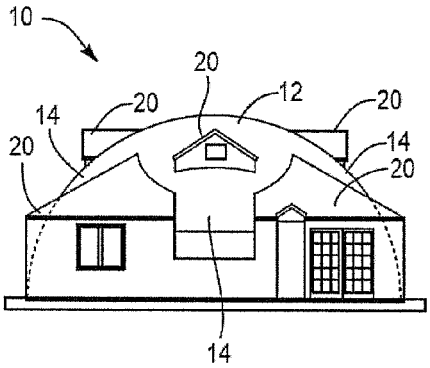
Figure 1C:
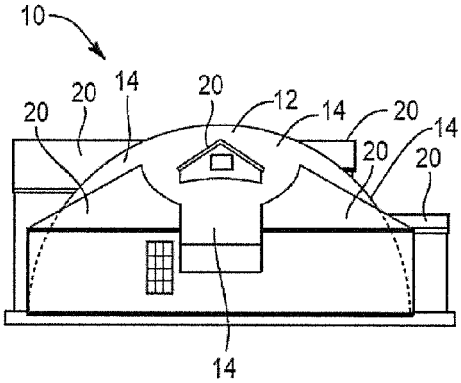
Figure 1D:
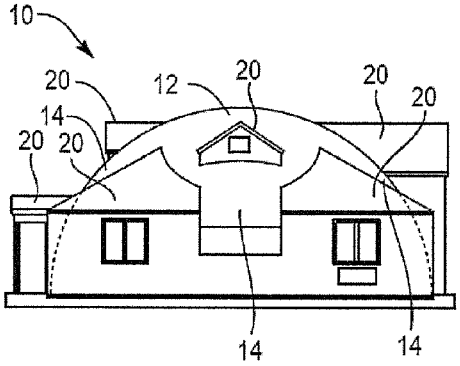
Figure 1E:
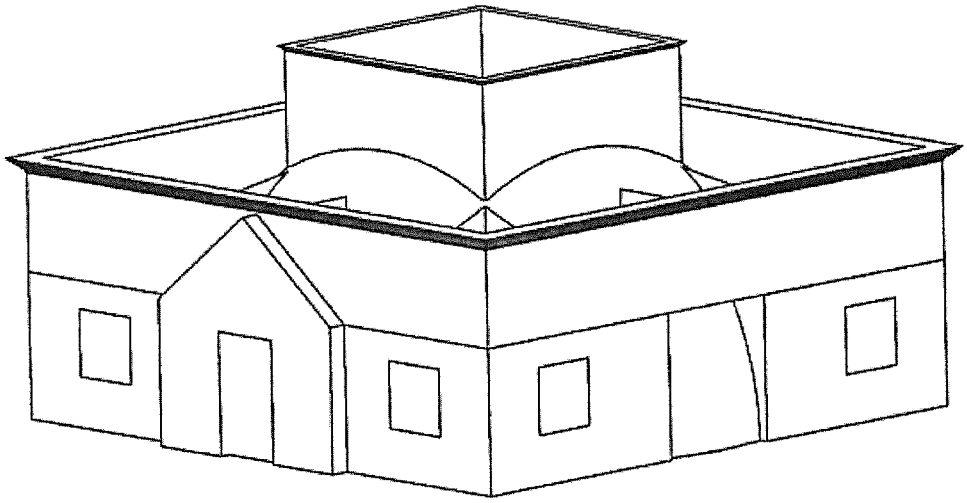

In other embodiments, such as the embodiment illustrated in FIG. 1E, a parapet is formed by extending the exterior walls above the lower arch line such that the extension partially or completely hides the cupola or arch apex. The parapet can completely hide any dome like features, thus making the exterior of the building more architecturally similar to traditional or regional construction, which may be required by many nationalities. Furthermore, the application of the parapet can transform the intersection of the arches, which naturally appears to be a dome, into an elliptical or polygonal shape. FIG. 1E further illustrates an interior parapet that sits on the bisecting arches and adds further dimension.

The process for constructing or forming monolithic building 10 generally begins with a foundation. Traditional dome buildings use a circular foundation, wherein the dimensions of the circular foundation approximate the circumference of the dome's base. However, some embodiments of monolithic building 10 can utilize a rectangular or other sized foundation to support the non-circular base of building 10.

Figure 2A:
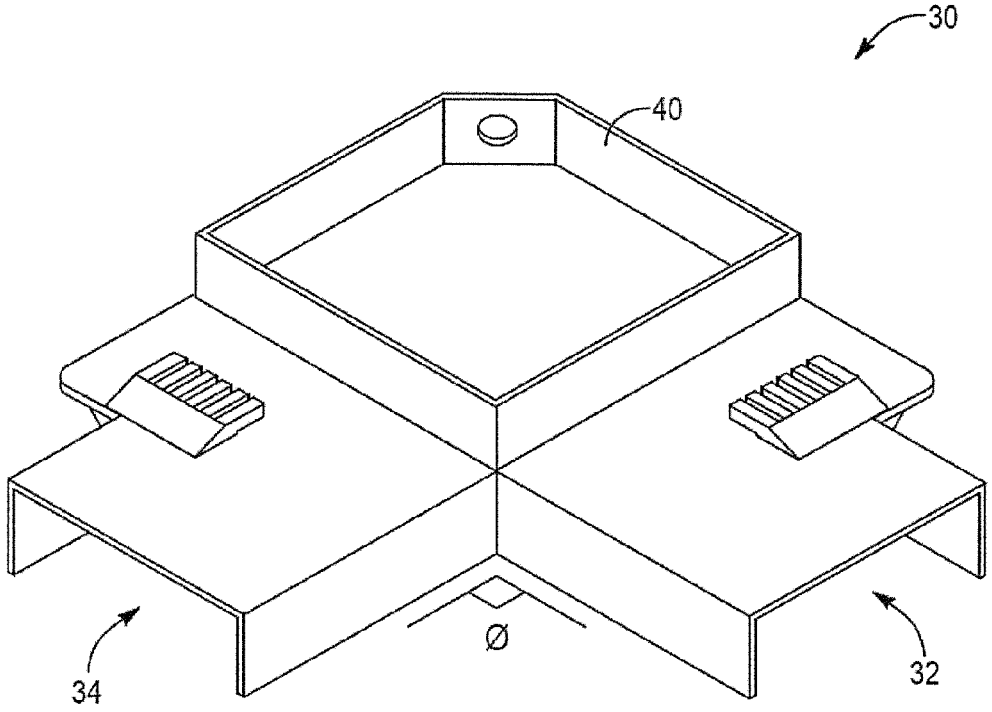
FIG. 2 as shown in parts A-C are perspective and plan views of a laser mounting device in accordance with a representative embodiment of the present invention.
Figure 2B:
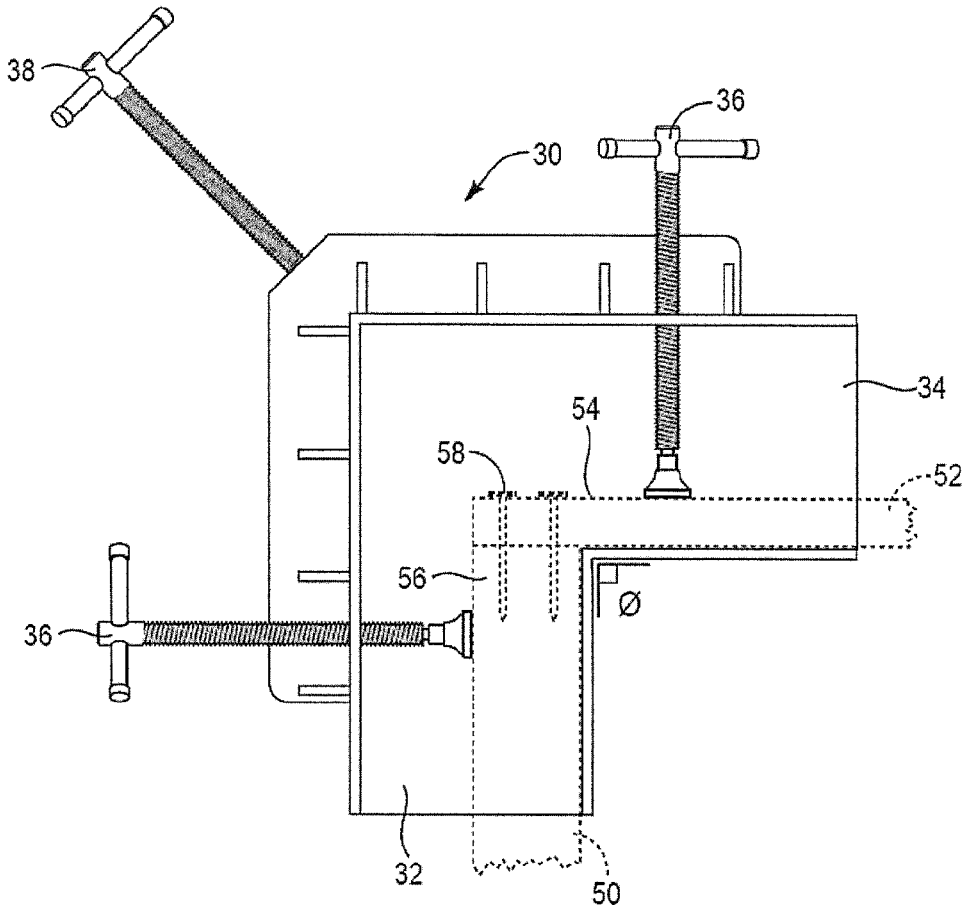
Figure 2C:
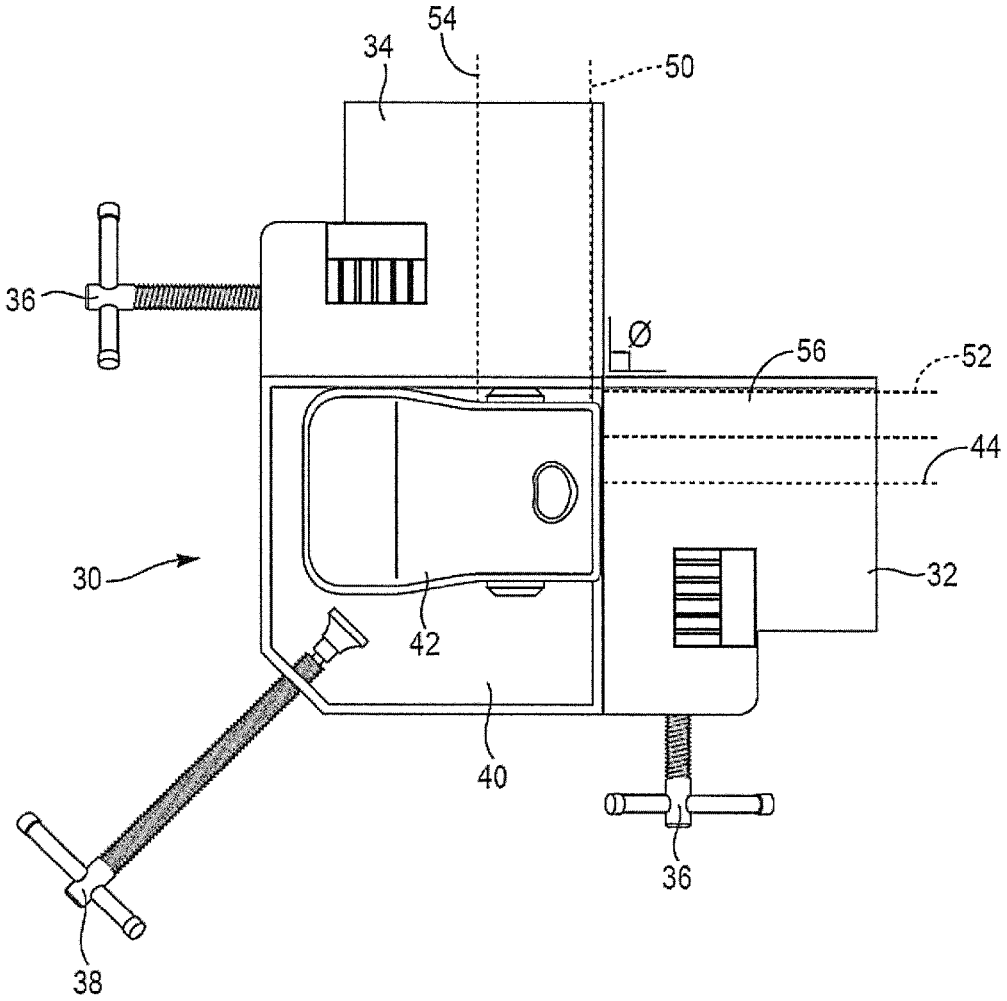
Figure 3:
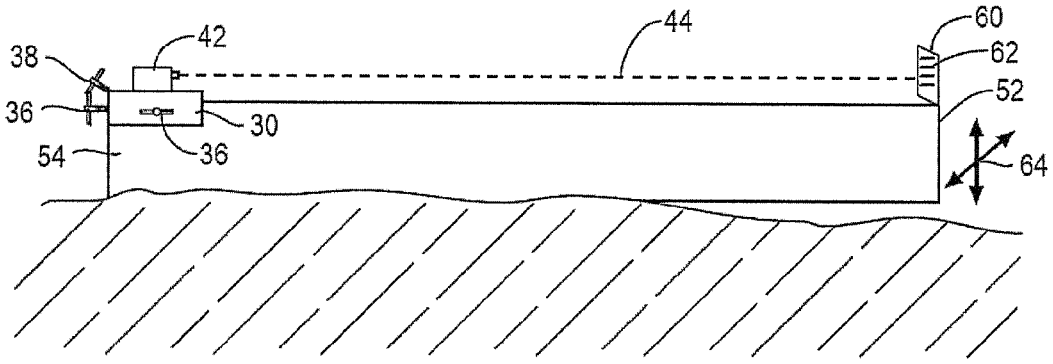
FIG. 3 is a plan side view of a laser mounting device and foundation form in accordance with a representative embodiment of the present invention.

In some embodiments, a laser mounting device 30, as shown in FIGS. 2A-3 is used to ensure that a foundation is provided that is square, plum and level. Some embodiments of laser mounting device 30 comprise an angled box having a first channel 32 and a second channel 34 for positioning mounting device 30 on the outside corner of any forming system. In some embodiments, first and second channels 32 and 34 are configured to snuggly receive nominal 2× material 50, such as a 2×4, 2×6, 2×8, or 2×10 piece of lumber. In other embodiments, channels 32 and 34 further comprises an adjustable clamp 36 whereby the width of channels 32 and 34 may be adjusted to snuggly receive and secure larger or smaller dimensioned forming materials 52.

Laser mounting device 30 further comprises a top compartment 40 for receiving a laser device 42. One having skill in the art will appreciate that any type of laser device may be used with laser mounting device 30, such as a dot/plumb laser, a grade laser, a manual leveling laser, a self-leveling laser, a line laser level, a pipe laser, a 180° line laser, and a 360° line laser. Laser device 42 is secured in top compartment 40 via laser vise or clamp 38.

The process for setting the foundation forms starts with a first forming material 54 being attached to a second forming material 56 at their ends to roughly provide a 90° corner θ. First and second forming materials are generally secured via fasteners, such as nails or screws 58. Laser mounting device 30 is then placed over the corner and clamps 36 are tightened thereby ensuring that the corner is maintained at 90°. Laser device 42 is then secured in top compartment 40 such that the laser beam 44 is directed along either of the first or second forming materials 54 and 56.

A target card 60 having a plurality of target lines 62 is then placed on the forming material 54 adjacent to laser mounting device 30. The position of the beam 44 relative to the target lines 62 is then recorded as a target mark. Target card 60 is then moved to the opposite end of forming material 54, whereafter forming material 54 is adjusted 64 until beam 44 registers at the target mark on the target card 60. The second end of forming material 54 is then secured at the desired position. At this point, the first and second ends of forming material 54 are level and aligned. This process is then repeated for each corner of the foundation forming system to provide a level and square foundation form.

In some embodiments, laser mounting device 30 further comprises a connection piece for compatible use with the Plastiform® system. As such, the process for building the foundation slab is simplified. This connection piece allows the form system to be suspended away from form stakes, which in turn allows for the use of a spin-screed or other large span, close edge finishing system, to be used for screeding the foundation material within the slab or foundation form.

Once formed, the foundation form is then filled with a foundation material by any method known in the art, thereby providing a rectangular foundation 70, as shown in FIG. 4. In some embodiments, the finished concrete slab foundation receives a burnished finish which allows for floor staining and polish, thereby eliminating the need for other floor finishes in the building 10. In other embodiments, a stamped faux tile, brick or other three-dimensional design is applied prior to the concrete setting.

In some embodiments, the length, width and height of foundation 70 is determined by use of a ruler or standard measuring tape. In other embodiments, foundation 70 and monolithic building 10 are constructed with the aid of coded architectural plans which utilize colors and symbols instead of numbers and words. In some embodiments, the coded architectural plans are accompanied by a set of tape measures that include matching symbols and colors. In other embodiments, the coded architectural plans are further accompanied with a video having various sections that allow those with limited or no reading skills to perform the necessary tasks to complete the monolithic building 10. Further, in some embodiments, physical or computer generated models are further provided to assist the user in constructing the building 10. In this way, foundation 70 and building 10 may be constructed without consideration for user education, nationality, language or sophistication.

Figure 4A:
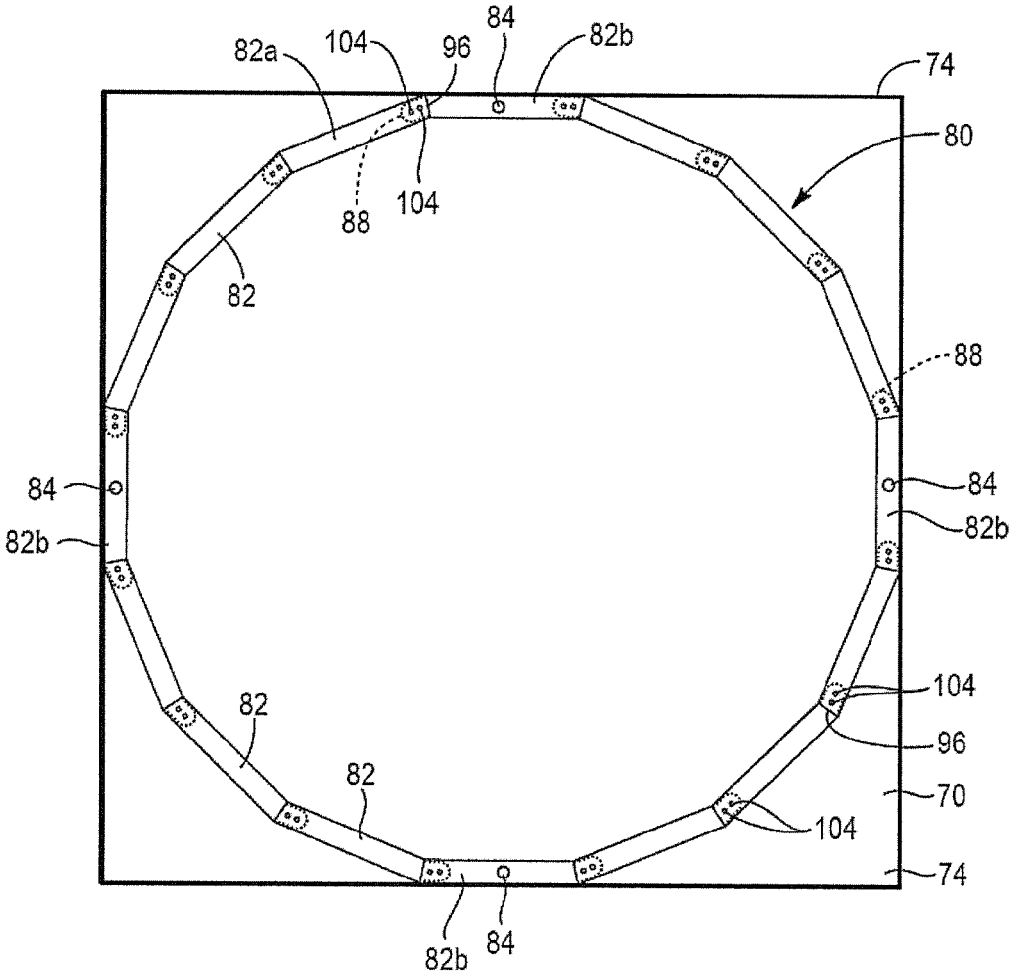
FIG. 4 as shown in parts A and B is a modular form securing system for securing an air form or other arch structured form to the foundation in accordance with a representative embodiment of the present invention.
Figure 4B:
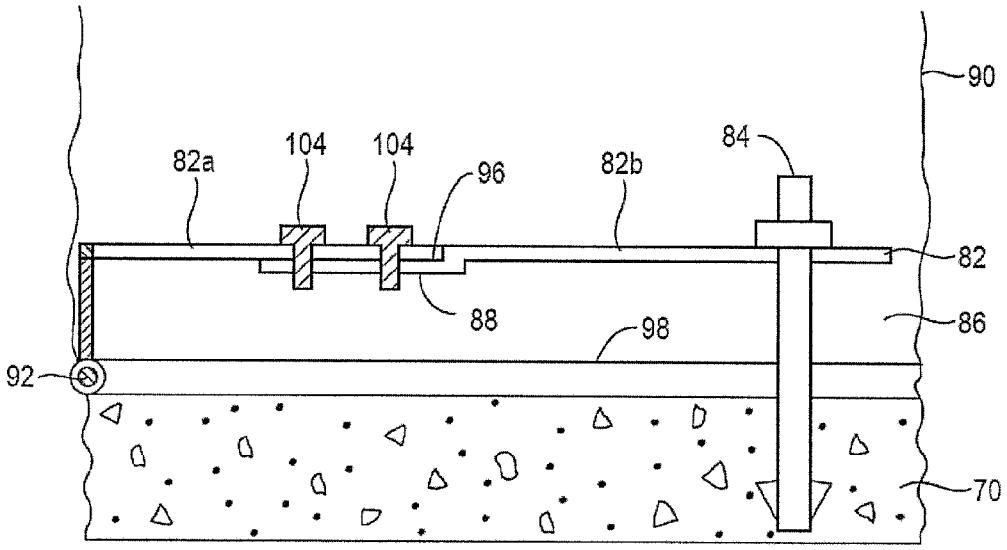
Figure 5A:
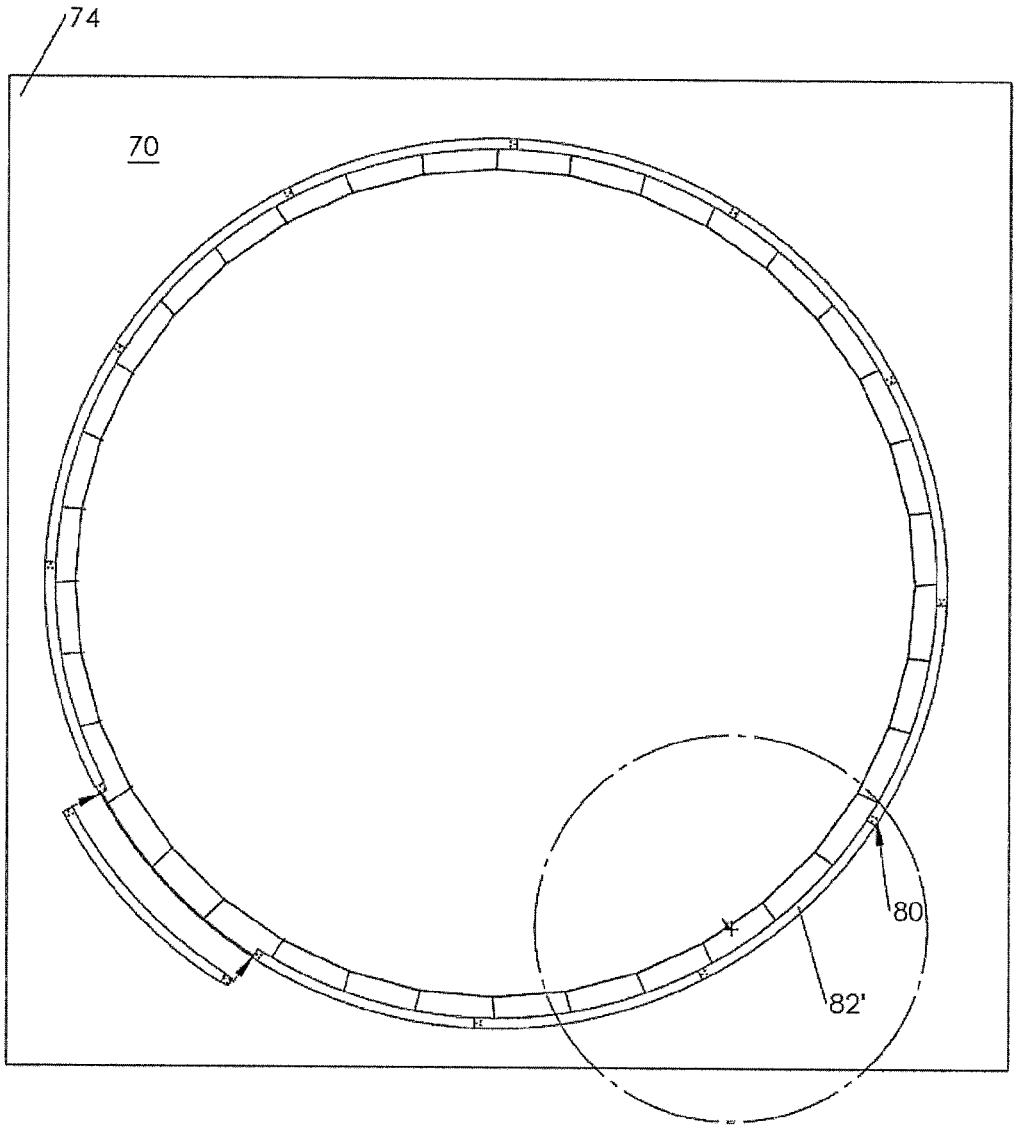
FIG. 5 as shown in parts A and B is another modular form for securing an air form or other arch structured form to the foundation in accordance with a representative embodiment of the present invention.
Figure 5B:
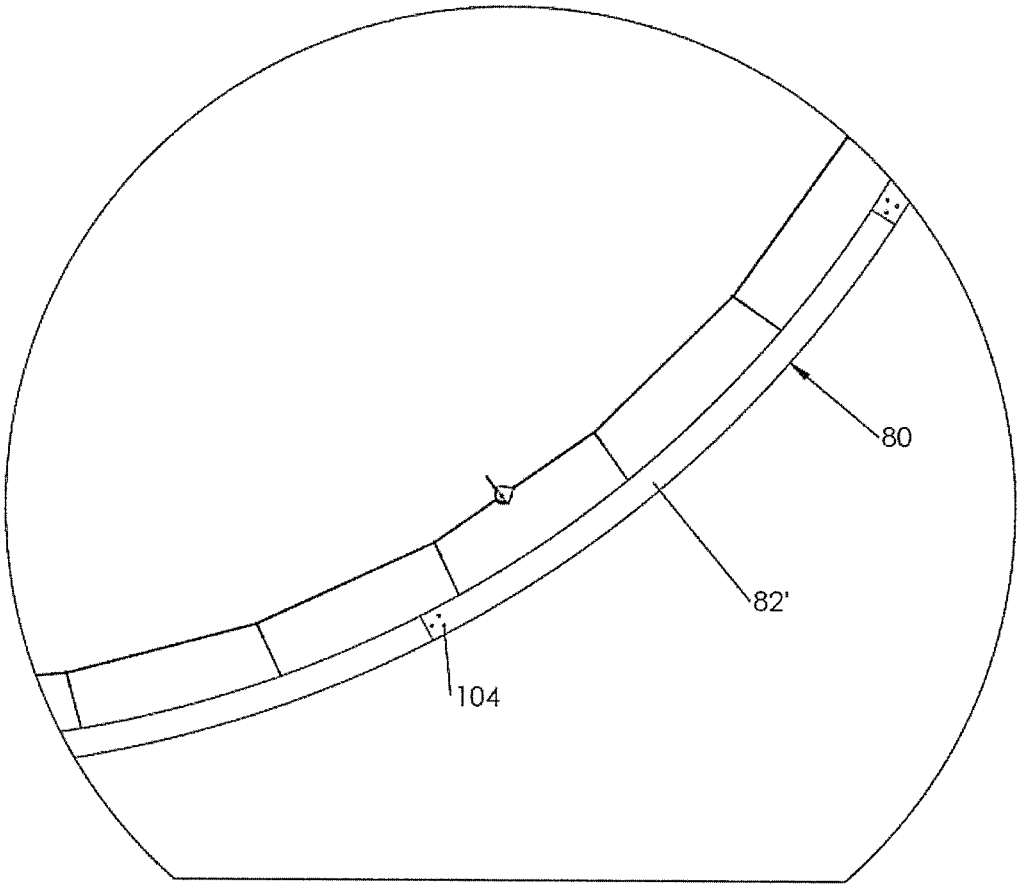

Building 10 is formed with the aid of a plurality of various forms. A first step in providing these forms is to secure an air or other arch structured form to the concrete slab 70 via a modular form securing system 80, as shown in FIGS. 4A through 6. In some embodiments, form securing system 80 comprises a plurality of interlocking c-channel sections 82, such as an aluminum c-channel, which are combined in a modular fashion to provide ring approximately equal to the circumference of a desired air form 90. In some embodiments, adjacent sections 82*a* and 82*b* are interconnected wherein a tongue 88 of section 82*b* is inserted into an opening 96 of section 82*a*. Sections 82*a* and 82*b* are then secured together via a plurality of fasteners 104. FIGS. 4A and 4B show straight sections 82, which combine to form a polygon-shaped securing system 80. Alternatively, FIGS. 5A and 5B show a modular form securing system 80 having arc-shaped sections 82' rather than the straight sections 82 of FIGS. 4A and 4B. The arc shaped sections 82' can collectively form a circle and create a more uniform shaped vault.

In some embodiments, sections 82*b* are secured to foundation 70 via fasteners 84, such as a expansive concrete anchor bolt, a wedge insert, a nail or a screw. Fasteners 84 are generally placed in sections 82*b* which are positioned closest to the perimeter edge 72 of foundation 70. As such, fasteners 84 are located adjacent to the outer wall of the final structure 10, as opposed to being positioned away from the wall opposite a corner 74 of the foundation 70. Prior to securing the sections 82 to foundation 70, a portion 92 of air form 90 is secured within the channel 86 of sections 82, such that a part of air form 90 is secured between shoring system 80 and foundation 70. For example, in some embodiments a rope or wire 92 is sewn into a bottom seam 98 of air form 90, thereby providing a surface which is capable of being retained in channel 86. Air form 90 is then connected to a fan or a plurality of fans (through a manifold system), such as a squirrel cage fan or other blower to inflate form 90, as shown.

Figure 6:
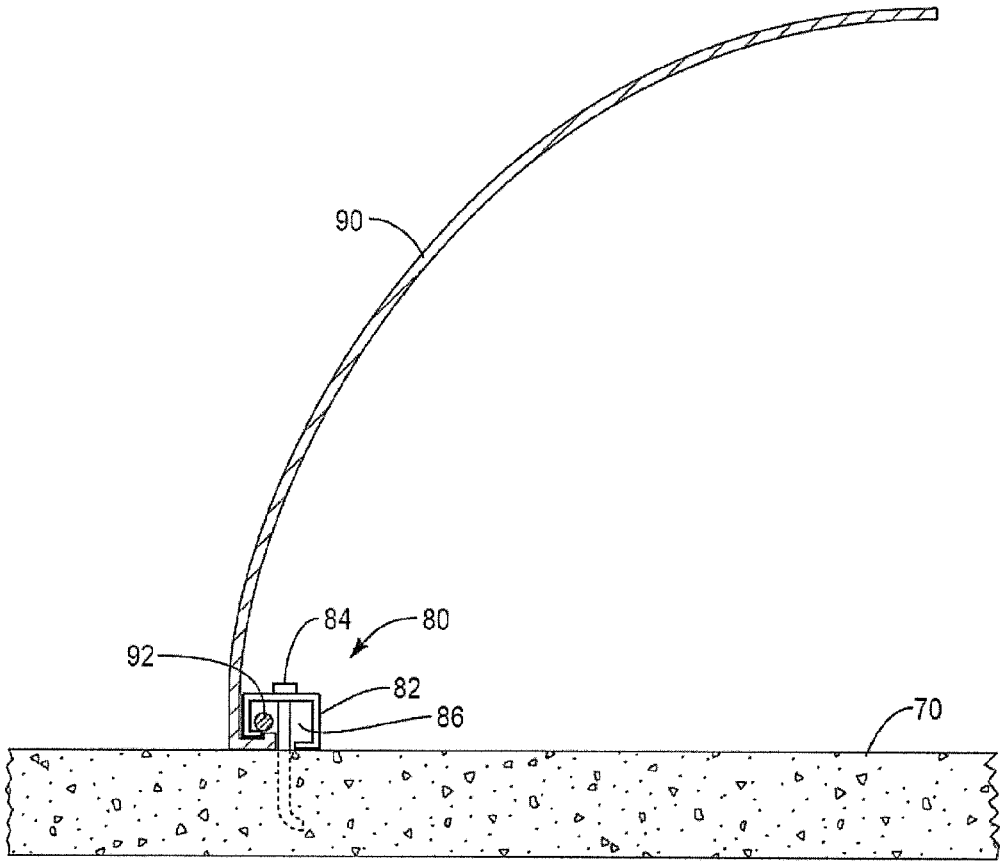
FIG. 6 is a cross-sectional view of an air form or other arch structured form secured to the foundation via a modular form securing system in accordance with a representative embodiment of the present invention.

FIG. 6 illustrates a cross-sectional view of an air form or other arch structured form secured to the foundation via a modular form securing system in accordance with another representative embodiment of the present invention.

Figure 7:
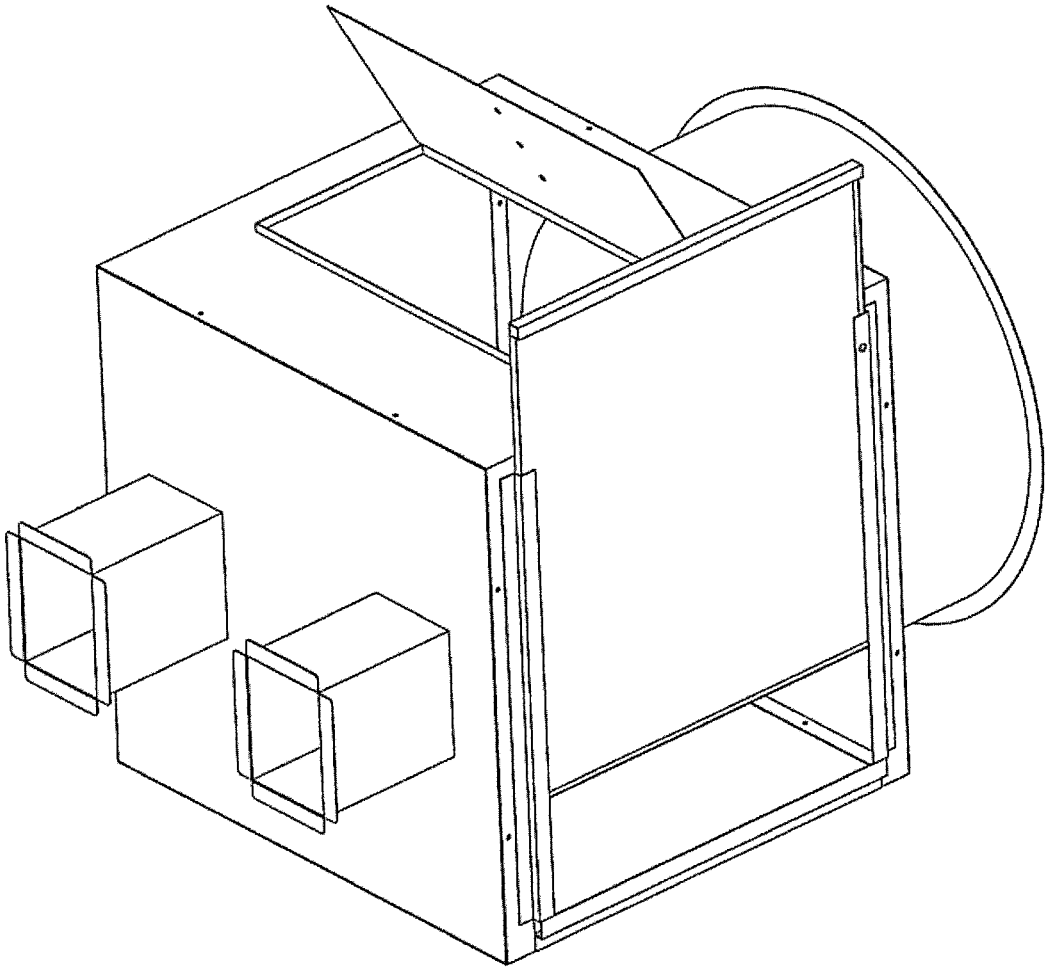
FIG. 7 is a perspective view of a fan manifold system in accordance with a representative embodiment of the present invention.

The air form is used for shoring and supporting the structure, including hip structures, as well as the weight of the cementitious material and reinforcing material applied to the exterior. The air form is placed as the main support structure for building 10 and therefore is placed approximately in the center of foundation 70. The fan(s) for the air form is/are set to maintain at least a three inch water column of continuous pressure within the interior of the air form. In some embodiments, an entrance is provided that is separate from the direct flow of air by the fan system. In some embodiments, the entrance is provided at the eventual location of a door or window of building 10, such that interior work on the building may be accomplished simultaneously with the exterior work of the building 10. In other embodiments, such as the embodiment illustrated in FIG. 7, the entrance is provided through a "trap door" in the fan manifold system. In FIG. 7, the slide door allows a person to crawl into the air form. The hatch at the top is a pressure regulator. Weights are stacked on top of the pressure regulator to hold it shut. When the pressure builds up, it will vent out the hatch. Those of ordinary skill in the art will appreciate that embodiments of the present invention contemplate other types of pressure regulators that may be used.

In FIG. 7, the fan manifold system allows a plurality of fans to be used and provides redundancy, which ensures that the minimum pressure is provided even if one fan fails. In further embodiments, the fans are hooked up to different power sources, such as one or more city power sources, one or more generator power sources, and/or one or more other power sources so that if one power source fails, the other fan(s) are able to provide the minimum pressure. Thus, in some embodiments, a plurality of fans are used that run off a plurality of power sources.

Figure 8:
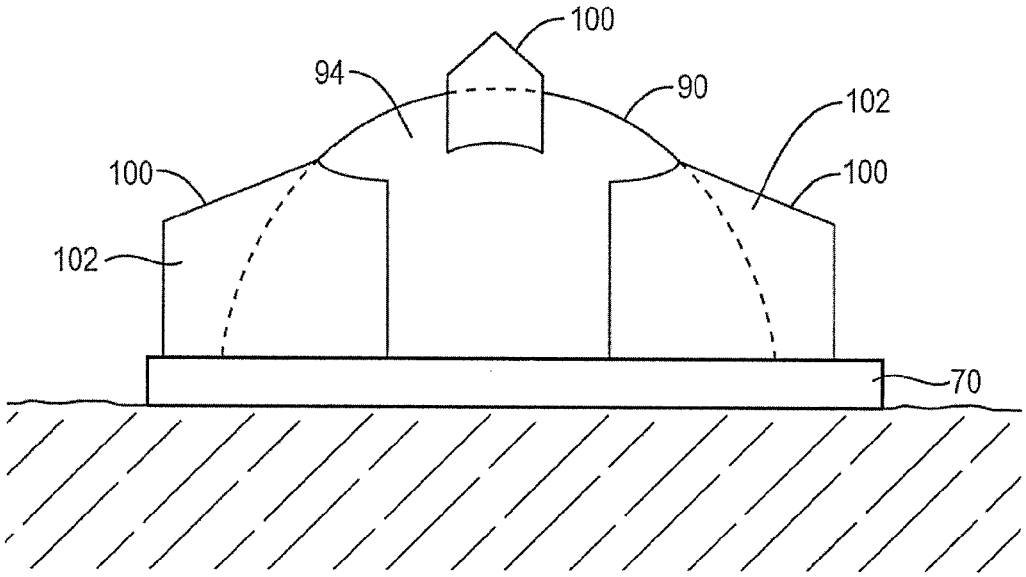
FIG. 8 is a plan view of an air form or other arch structured form and various hip forms supported by the air form or other arch structured form in accordance with a representative embodiment of the present invention.

Referring now to FIG. 8, the various forms used to construct building 10 can further comprise a plurality of hip forms 100. In some embodiments, hip forms 100 comprise a desired three-dimensional shape which is attached or otherwise coupled to air form 90. Thus, the outer surface 94 of air form 90 and the outer surfaces 102 of hip forms 100 provide a combined outer surface that defines the inner and outer shape, profile and/or design of monolithic building 10. Hip forms 100 may include any desired shape or structure. For example, in some embodiments hip form 100 comprises a dormer shape. In other embodiments, hip form 100 comprises a shape reflective of a garage, a nook, an entryway, and/or a room.

Figure 9A:
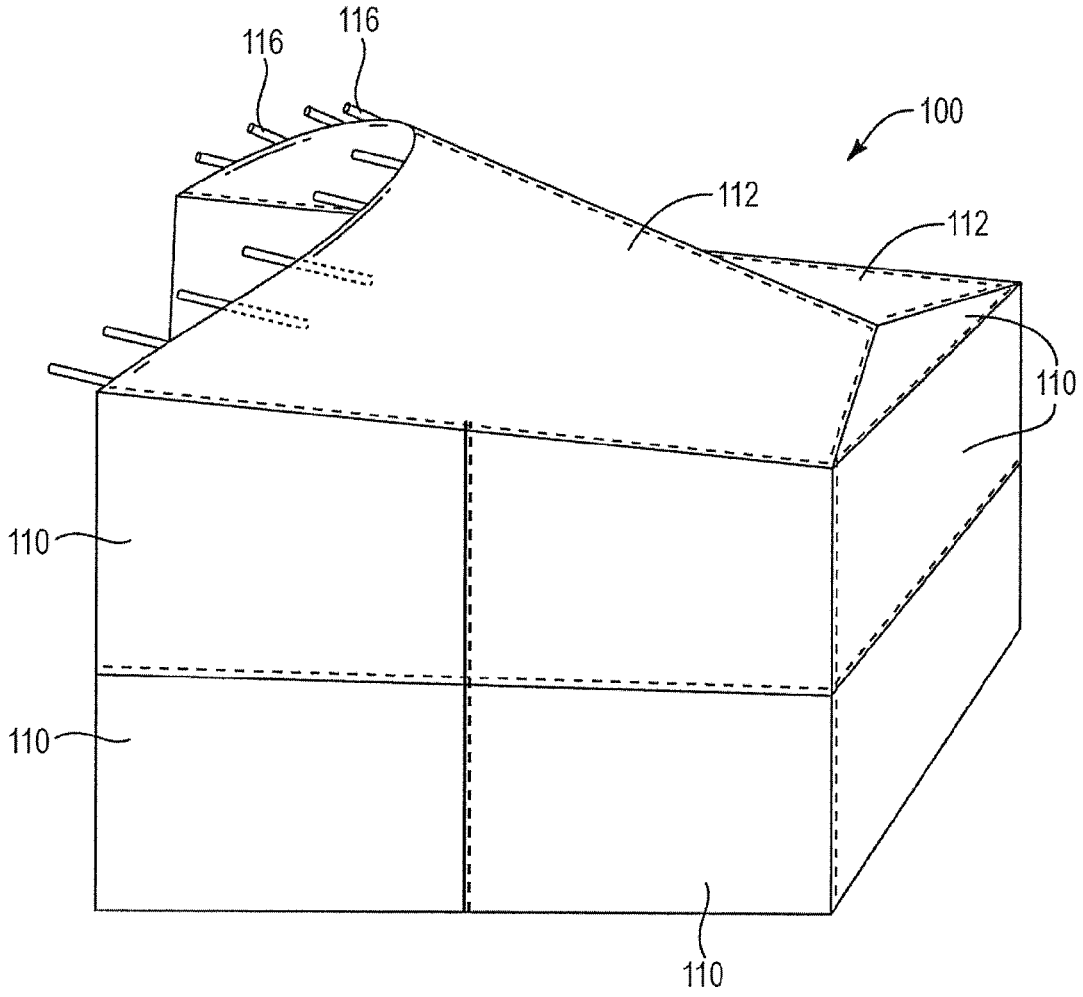
FIG. 9 as shown in parts A-C is a perspective view of an assembled hip form in accordance with a representative embodiment of the present invention.
Figure 9B:
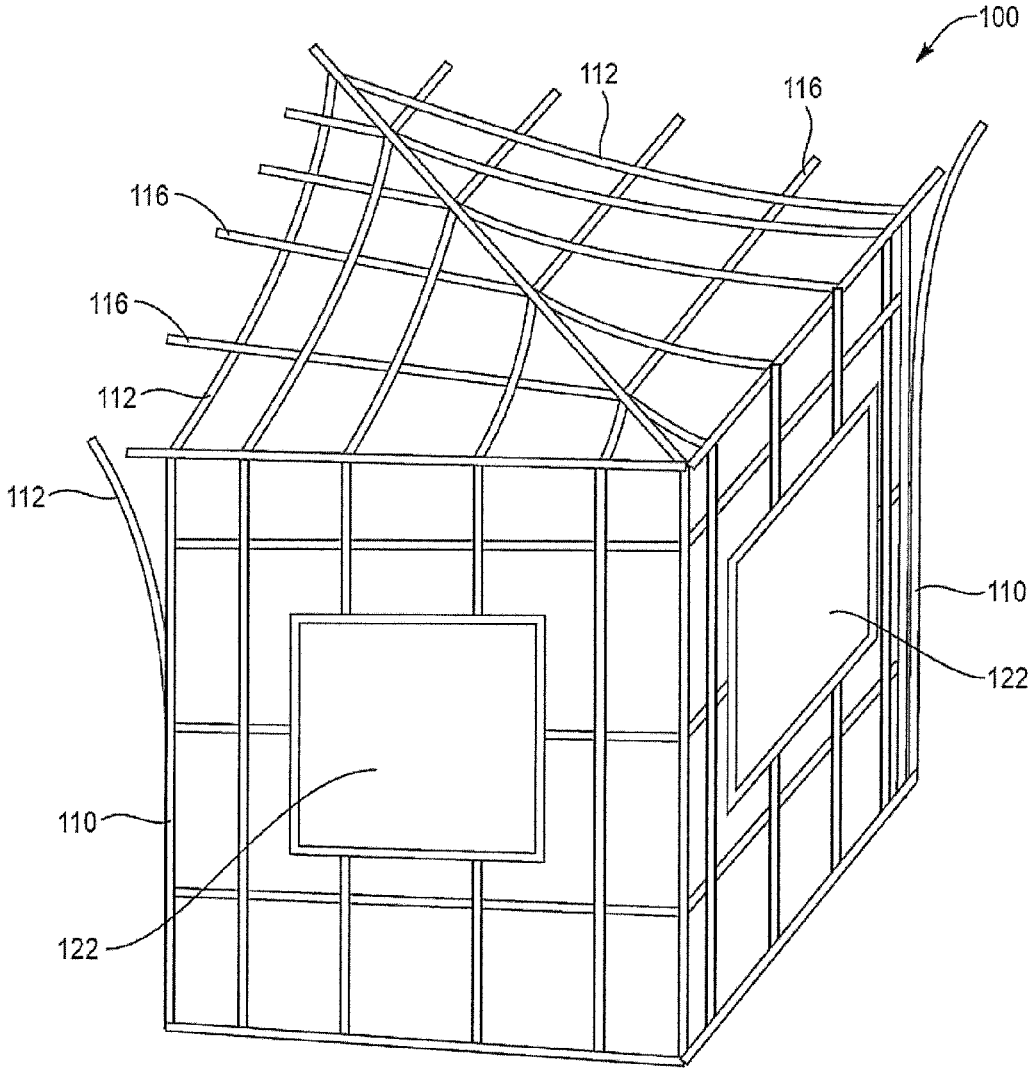
Figure 9C:
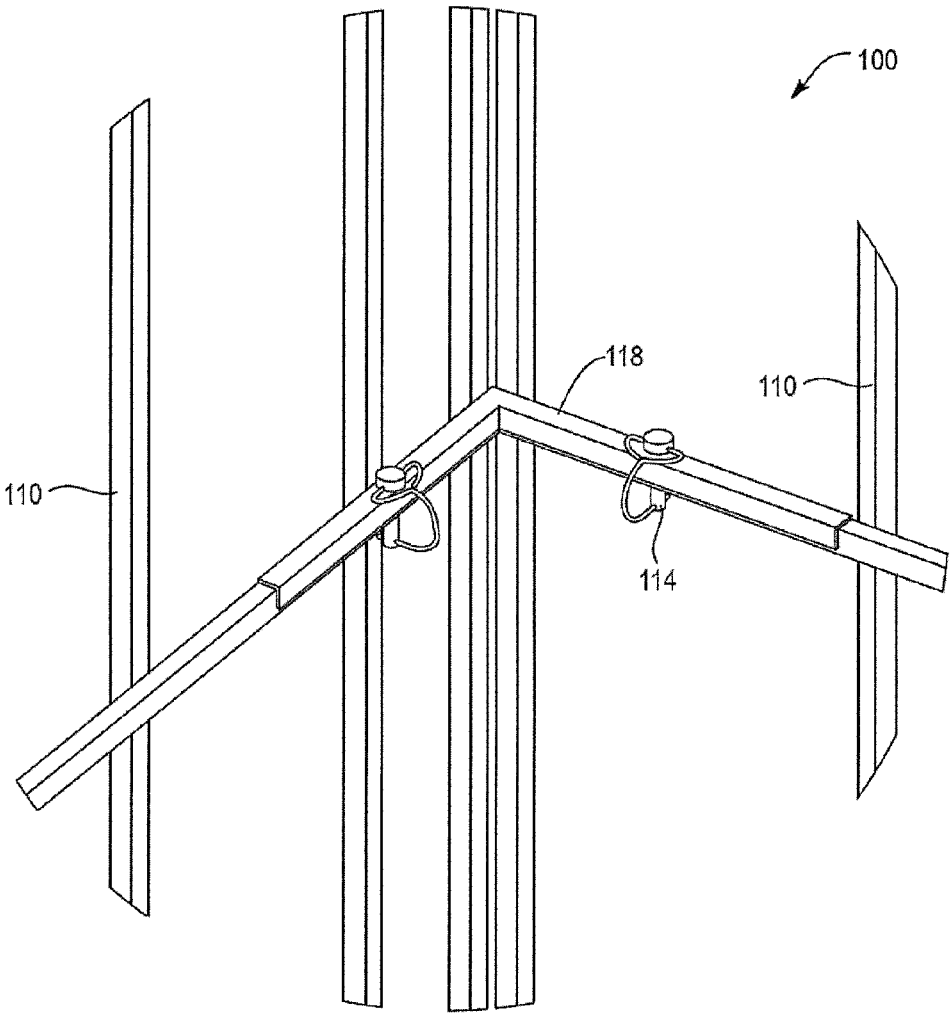
Figure 10:
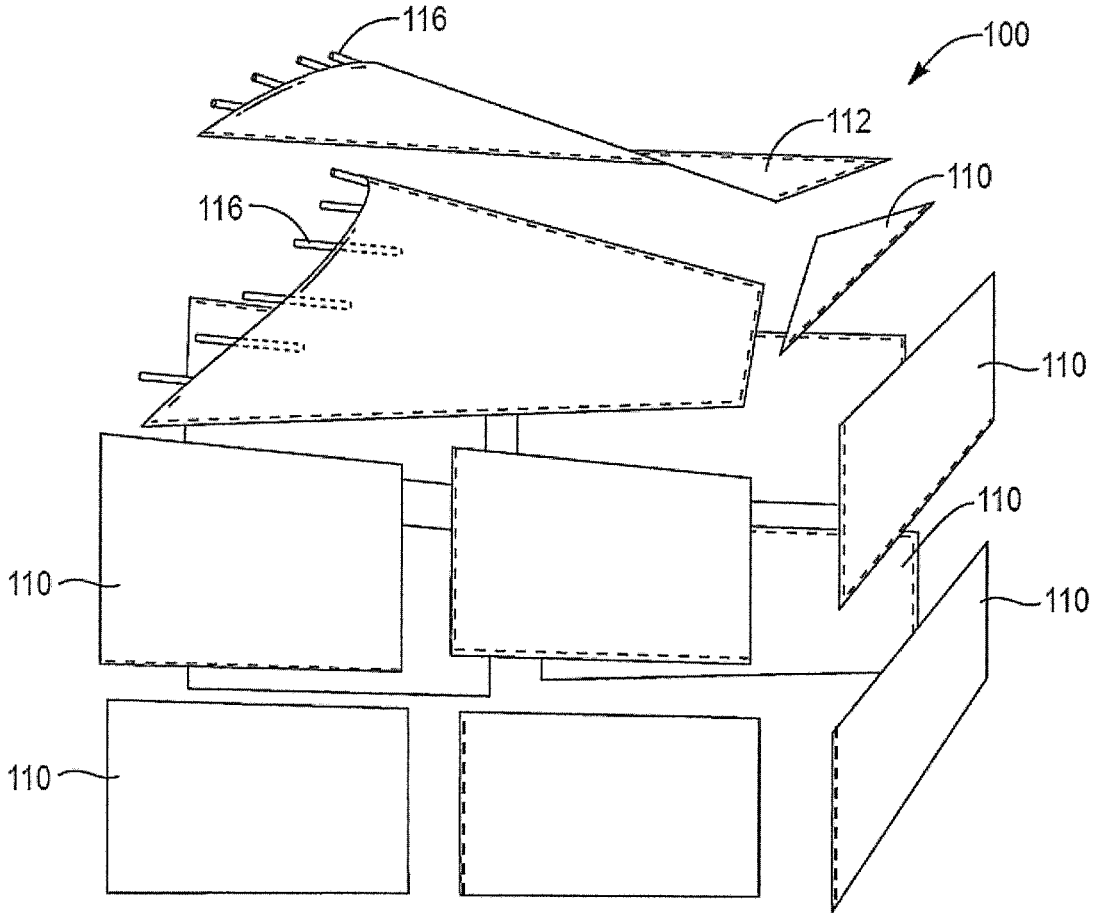
FIG. 10 is a perspective, exploded view of a disassembled hip form in accordance with a representative embodiment of the present invention.

In some embodiments, hip forms 100 comprise a system of vertical and horizontal modular pieces 110 that are interconnected via spring clips 114 and rods 116 which are manufactured to best fit the forms, as shown in FIGS. 9 and 10. In some embodiments, vertical and horizontal pieces 110 are sized so as to facilitate removal of hip forms through a window, door, or sliding glass door following completion of building 10. For example, in some embodiments pieces 110 are sized such that building 10 must include an opening having a diagonal dimension of at least six feet to enable removal of the individual pieces 110 from the interior of the finished monolithic building 10.

In some embodiments, the vertical and horizontal pieces 110 are configured of grids of tubular steel made to match a one foot center rebar layout, as shown in FIGS. 9B and 9C. This system allows for rebar to be installed around the perimeter of building 10 without the use of tape measures or measuring sticks. In some embodiments, hip forms 100 are manufactured to include cutouts 122 configured to fit windows and doors of varying sizes and layouts. This allows the builder to perfectly place door and window layouts without the use of tape measures or other devices which require literacy capabilities. In some embodiments, the hip form system is used for interior applications. In some embodiments, the hip form system is used for exterior applications. In some embodiments, hip forms 100 include turnbuckle braces placed periodically around the perimeter of the air form 90 so that the assembled pieces of the shoring system 80 can stand independently. Further, in some embodiments adjacent sections are interconnected at 90° via a jig 118, as shown in FIG. 9C. Still further, in some embodiments arches are used to support the hip form structurally. Such use of arches to support a hip form is illustrated, by way of example, in FIGS. 15-16.

As shown in FIG. 10, in some embodiments, a top section 112 is provided to form various roof shapes. The top section pieces 112 are made in a similar manner as the vertical and horizontal hip form pieces, only rods 116 are placed in the end of hollow form pieces that can extend to match various roof pitches, or to vaulted air forms 90. In some embodiments, top sections 112 further comprise a clamping mechanism whereby to allow each extension rod or tube 116 to be set at a desired extension length. Extension rods or tubes 116 can be covered with a tubular shield, such as one-inch polyvinylchloride pipe. The tubular shield then acts as a cutting guide for foam or insulation pieces which are positioned over the shields between top sections 112 and the outer surface of air form 90.

Once the forms are completed, the next step in the construction process of monolithic building 10 is to cover the various forms 90 and 100 with an insulating material, such as dense or medium-dense polystyrene sheet foam. In some embodiments, liquid thermoset foam is sprayed onto the exterior surfaces of forms 90 and 100. In some embodiments, a releasing agent is applied to outer surfaces of forms 90 and 100 prior to applying or spraying a liquid insulating material to the forms.

The process for applying the insulating material to the outer surfaces of forms 90 and 100 entails cutting the insulating material into shapes and sizes that correspond to the cumulative outer surface of forms 90 and 100. Thus, a continuous layer of insulating foam is applied to the entire outer surface of forms 90 and 100. In some embodiments, an adhesive is used to join adjacent pieces of insulating material. In other embodiments, adjacent pieces of insulating material are interconnected via rods, clips, adhesive tape, rope or some other tethering device or material. Once completed, a lattice of rebar is applied to the outer surface of the insulating material.

In some embodiments, the insulating material is replaced with re-usable sheeting made of a strong and often light weight material such as polycarbonate or another polymer material to act as a backing when the cementitious exterior coating is applied. The re-usable sheeting is removed along with the form system and is used over and over with the form system.

Figure 11A:
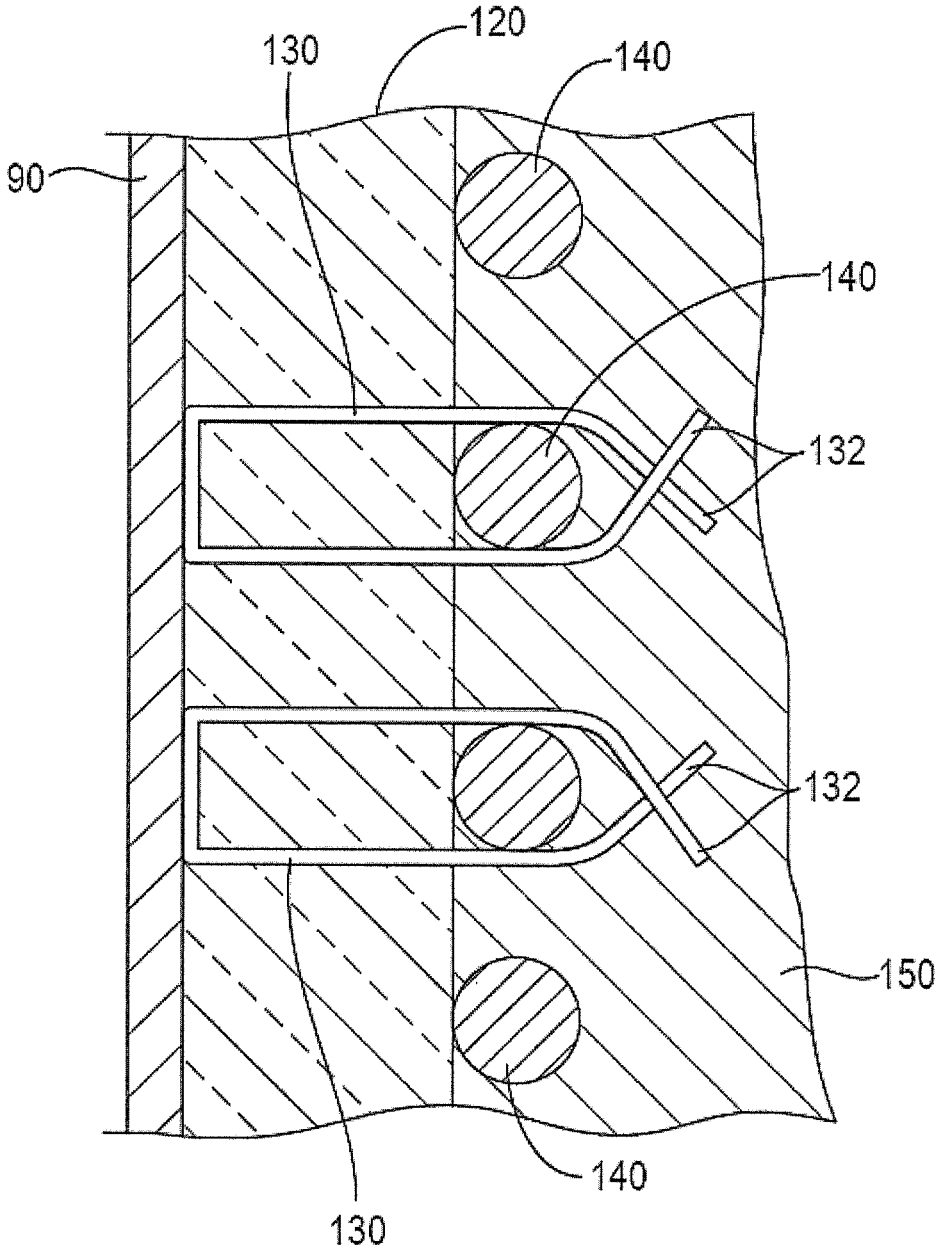
FIG. 11 as shown in parts A and B is a cross-sectional view of a completed arch structured wall prior to removal of the air form in accordance with a representative embodiment of the present invention.
Figure 11B:
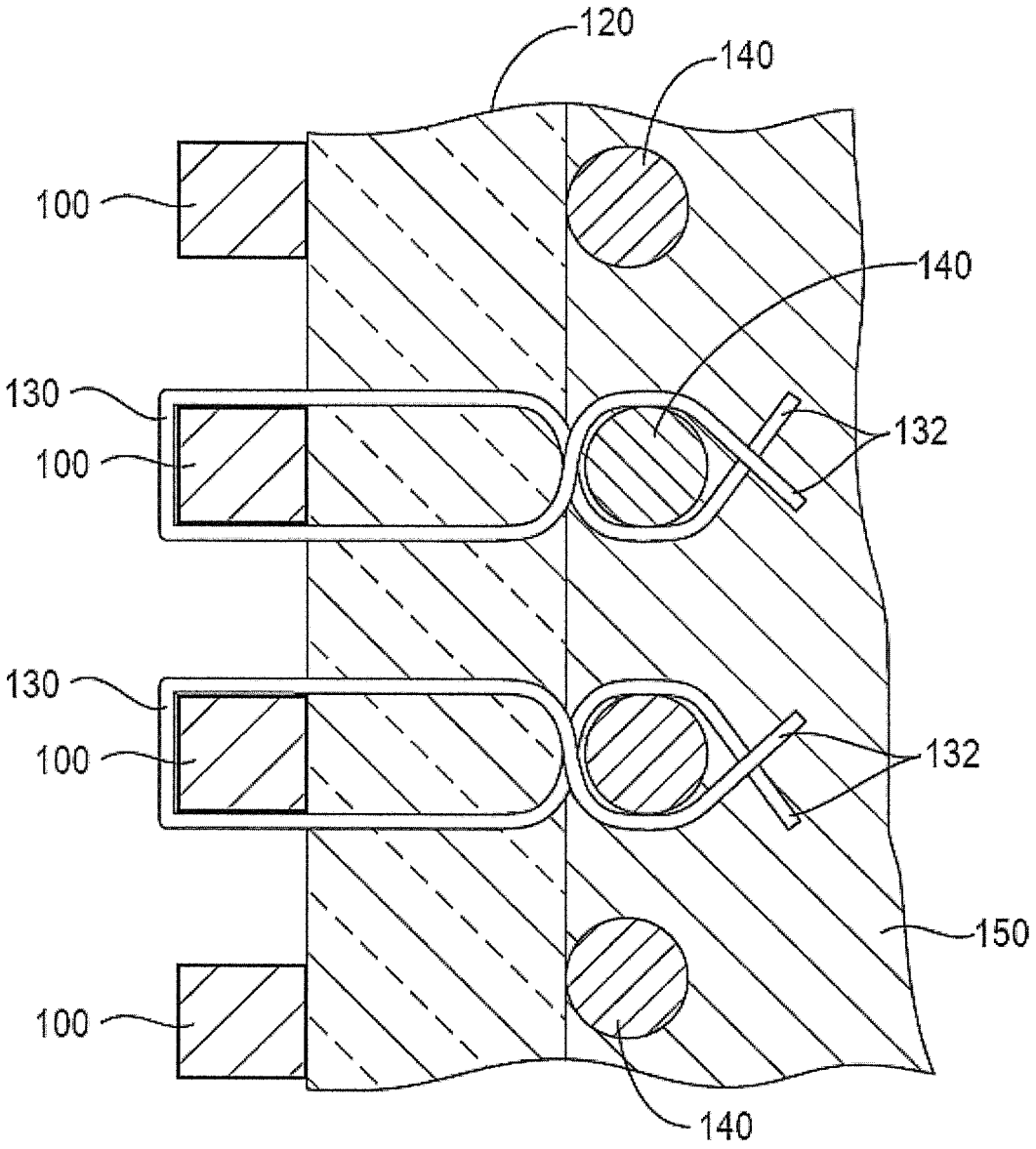

In some embodiments, the insulating material 120 is equipped with a rebar anchoring system 130, as shown in FIGS. 11A and 11B. For example, in some embodiments, a staple 130, such as a landscape staple is melted into the insulating material 120 prior to installing the insulating material onto the outer surface of forms 90 and 100. Staple 130 may be preheated via an open flame and subsequently pushed into insulating material 120 thereby leaving free ends 132 on the outer surface of material 120. When applying rebar 140 to the outer surface of material 120, rebar 140 is secured to material 120 by twisting or wrapping free ends 132 around rebar 140. Free ends 132 are further secured by being covered and set in cementitious exterior coating material 150. In some embodiments, staple 130 is further tied around a portion of form 100 thereby securing insulating material 120 to forms 100. Following application of coating material 150, staples 130 are cut thereby releasing forms 100 from insulating material 120. The cut ends of staples 130 are then bent flat against insulating material 120 and covered by an interior finishing material, such as plaster, insulation, or another finishing material.

Figure 12:
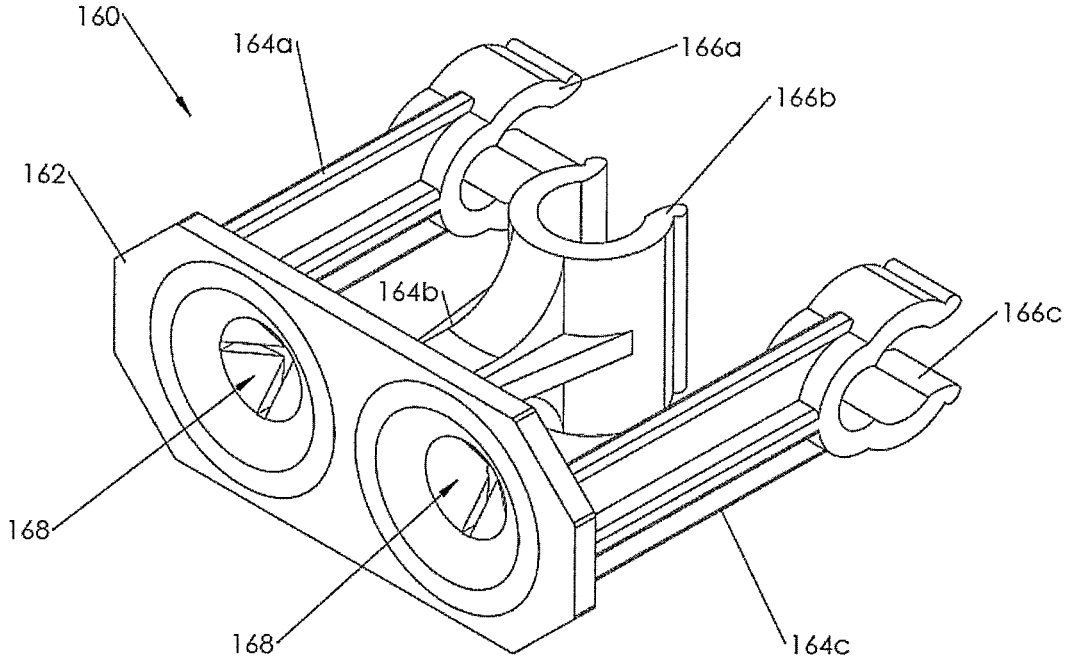
FIG. 12 is a perspective view of an attachment mechanism in accordance with a representative embodiment of the present invention.
Figure 13A:
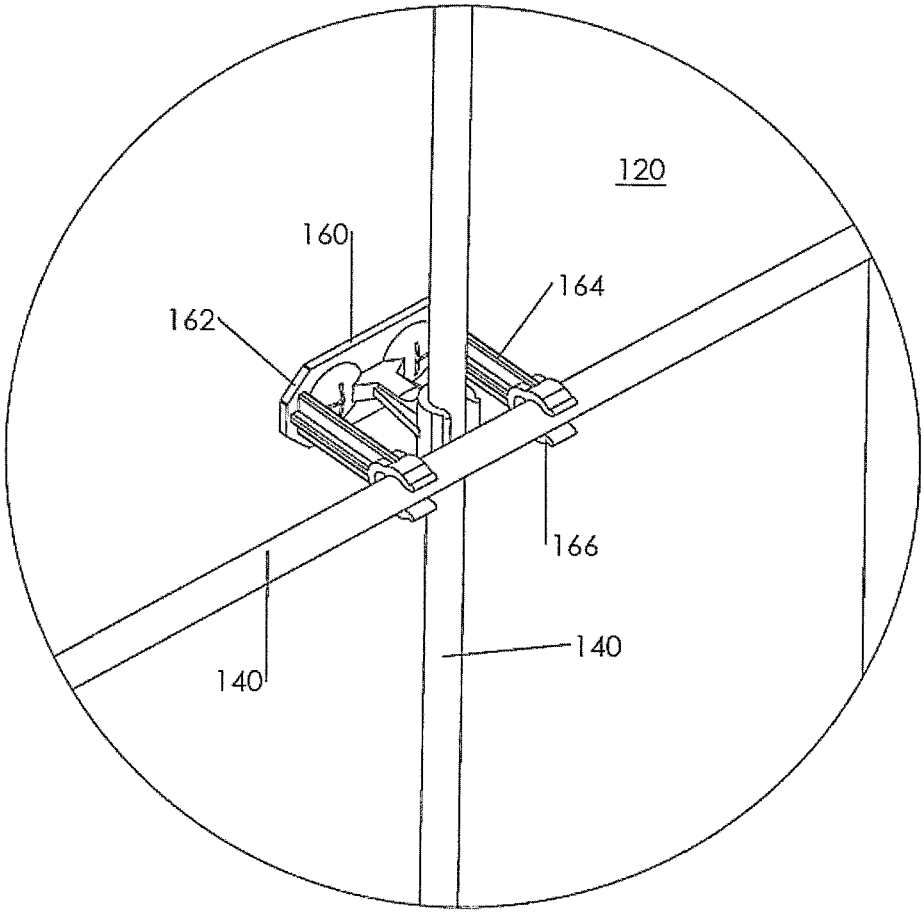
FIG. 13A is a perspective view of the attachment mechanism of FIG. 12 in use in accordance with a representative embodiment of the present invention.
Figure 13B:
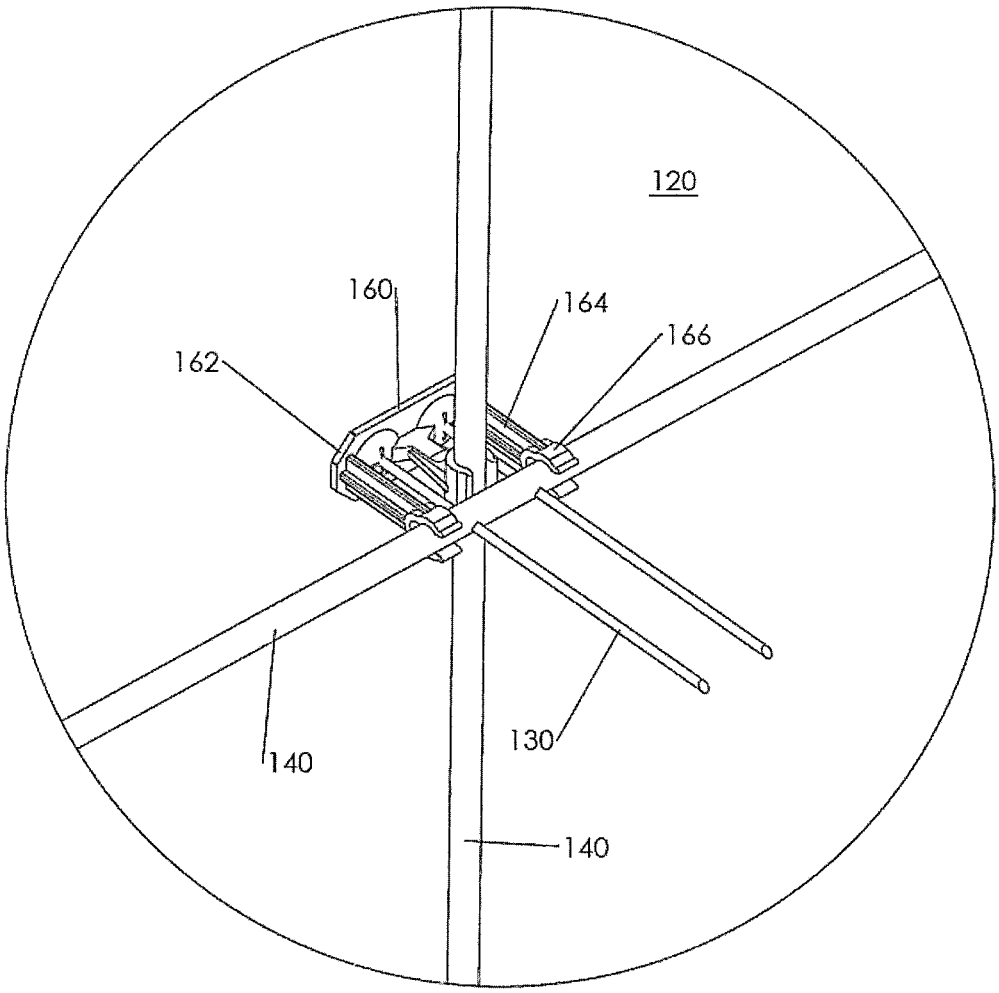
FIG. 13B is another perspective view of the attachment mechanism of FIG. 12 in use in accordance with a representative embodiment of the present invention.

In some embodiments, it can be desirable to provide a space between the rebar 140 in the insulating material 120. Accordingly, FIGS. 12, 13A and 13B show a spacer 160 that can be placed between the rebar 140 in the insulating material 120. The spacer 160 can includes a base 162 that has a substantially planar back surface that is placed against the insulating material 120. The base 162 can be secured to the insulating material 120 via one or more holes 168 in the base 162. Furthermore, in some embodiments, as shown in FIG. 13B, staples 130 can extend through these holes 168. The spacer 160 can secure the rebar 140 within one or more clips 166 (shown as clips 166*a*, 166*b*, and 166*c*) coupled to arms 164 (shown as arms 164*a*, 164*b*, and 164*c*) that are coupled to the base 162. The clips 166 can be C-clips or another type of clip. Similarly the clips 166 can be replaced with another type of fastener. The arms 164 can extend away from the base 162. Thus, in use, the arms can extends away from the insulating material 120 to provide a space between the insulating material 120 and rebar 140 that is supported by the clips on 166.

As shown, the spacer 160 can be configured to hold two or more pieces of rebar 140. Moreover, the arms 164 can have various lengths. For example, as shown, arms 164*a* and 164*c* are longer than arm 164*b*. Additionally, clips 166*a* and 166*c* coupled to arms 164*a* and 164*c*, respectively, are oriented at a 90° offset in relation to clip 166*b* coupled to arm 164*b*. As such, clip 160 can support a vertical piece of rebar 140, while clips 166*a* and 166*c* can support a horizontal piece of rebar 140, or vice versa. Thus, the spacer 160 shown in FIG. 12 can secure both a horizontal and a vertical piece of rebar 140 away from the insulating material 120, as shown in FIGS. 13A and 13B. Moreover, the spacer 160 can be oriented so that it supports rebar 140 at angles other than purely horizontal and purely vertical.

Figure 14:
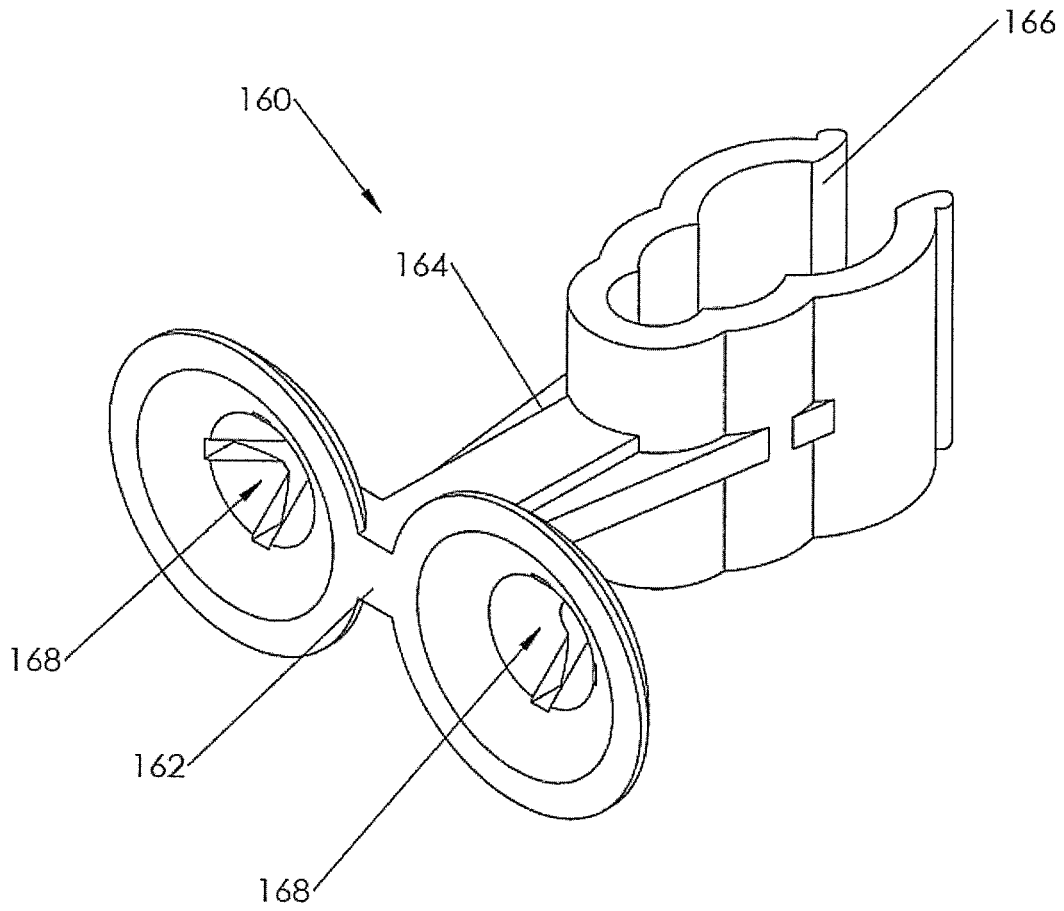
FIG. 14 is a perspective view of another attachment mechanism in accordance with a representative embodiment of the present invention.

Referring to FIG. 14, the spacer 160 can be configured to hold only a single piece of rebar 140. As shown, the spacer 160 can include only a single arm 164 that has only a single clip 166. As will be understood, the spacer 160 can be oriented on the insulating material 122 to position a piece of rebar 140 within the clip 166 in any orientation, such as horizontally, vertically, or at any other angle.

As further shown in FIG. 14, the clip 166 can be shaped, sized, and/or otherwise configured to be capable of securing one or more sizes of rebar 140 within the clip 166. As shown, the inner surface of the clip 166 includes a first inner surface that is closest to the base 164 that is shaped and sized to hold a smaller sized piece of rebar 140. The inner surface of the clip 166 can also includes a second set of surfaces next to the first inner surface that is shaped and sized to collectively secure a larger piece of rebar 140. Inner surface of the clip 166 can further include a third set of surfaces that is farthest away from the base 162. This third set of surfaces can be shaped and sized to hold an even larger piece of rebar 140, as shown. Moreover, in other embodiments the clip 166 can be configured to hold only two sizes of rebar 140, as shown in FIG. 11, or be configured to hold for or more sizes of rebar 140.

Referring again to FIGS. 10A and 10B, a finishing step in the construction process for monolithic building 10 is the application of an exterior coating material 150. As previously discussed, exterior coating material 150 generally includes a cementitious material which is rigid and weather resistant. In some embodiments, material 150 is fire resistant. In some embodiments, material 150 is applied using an air assist spray and pump. In other embodiments, material 150 is applied by hand. In some embodiments, material 150 is applied to a desired thickness via a plurality of thin coats. Once a desired thickness is achieved, forms 90 and 100 are left in place for the required cure time according to the requirements of the selected exterior coating material 150. Once cured, forms 90 and 100 may be removed from the building structure 10.

In some embodiments, a further finishing step is performed wherein a polyicocyanurate foam or urethane foam is applied to the inside and/or outside surfaces of the completed dome building 10. This additional material is applied at one to three inches and is then covered with various elastomeric or cementitious coatings or other appropriate surfaces to achieve a desired aesthetic appearance, acoustic attenuation, and other practical needs for the structure.

Figure 15:
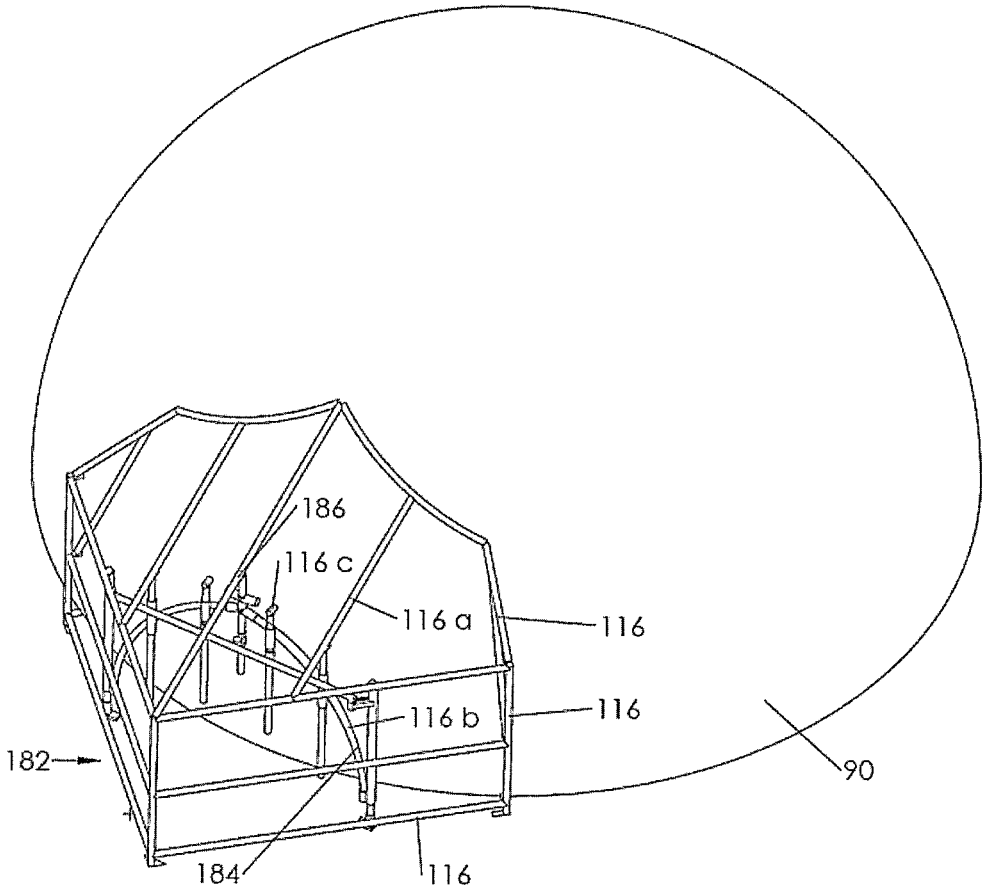
FIG. 15 is a perspective view of an air form and a hip form in accordance with a representative embodiment of the present invention.
Figure 16:
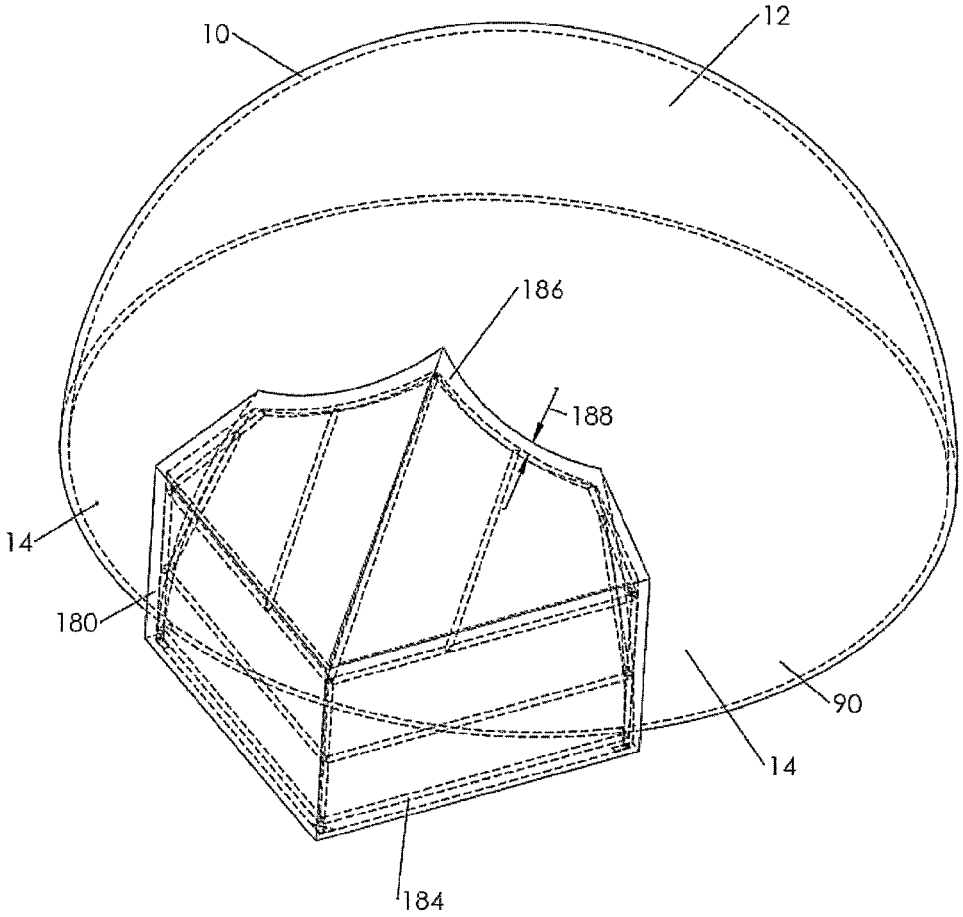
FIG. 16 is a partial perspective view of the air form and hip form of FIG. 15 with an arched or vaulted structure shown as a transparent structure in accordance with a representative embodiment of the present invention.
Figure 17:
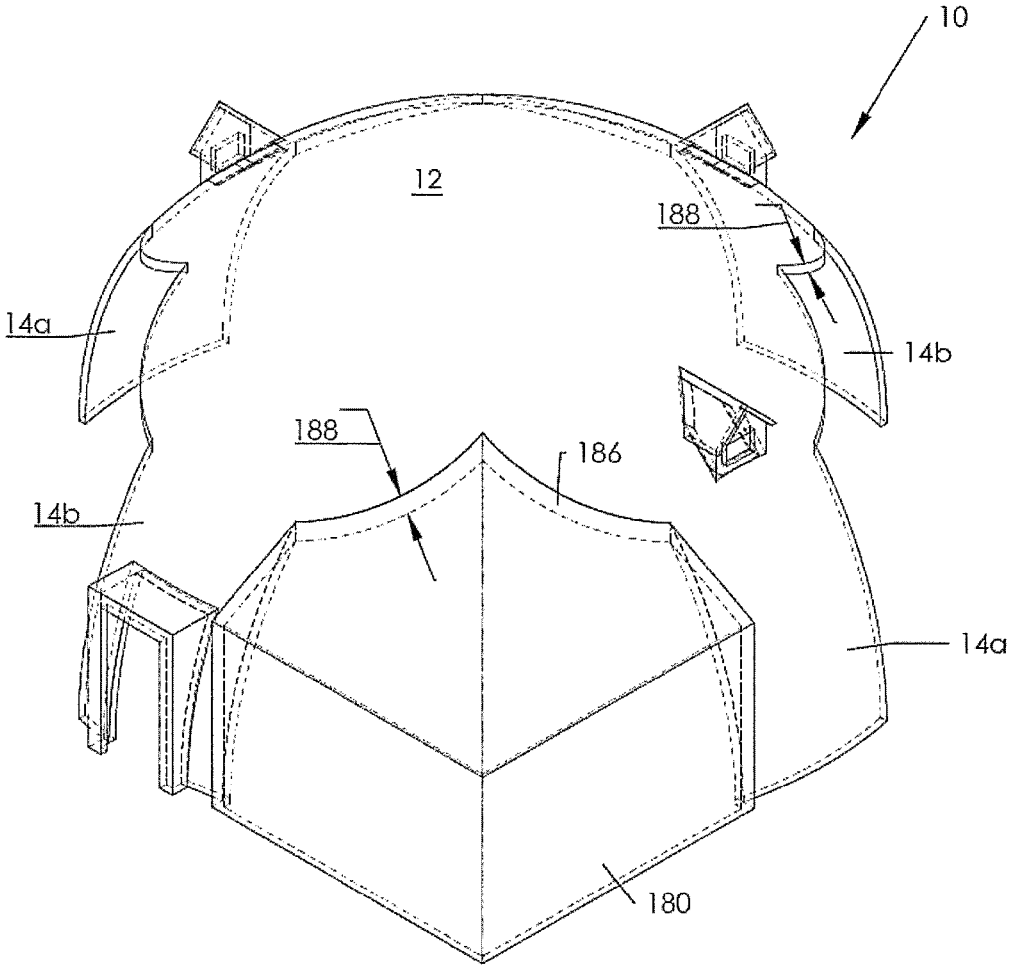
FIG. 17 is a perspective view of an arched or vaulted structure shown as a transparent structure to illustrate the thicknesses and boundaries of the structure in accordance with a representative embodiment of the present invention.

Reference will now be made to FIGS. 15 through 18C, which provide a detailed illustration of the construction of a building 10 having a representative hip structure 20, and the interface between the hip structure 20 (specifically a corner structure 180) the arches 14 the vaulted apex 12. Reference will first be made to FIGS. 15 through 17. FIG. 15 illustrates a corner form 182 and air form 90 used in the construction of a hip structure (corner structure 180). FIG. 16 illustrates a portion of the corner form 182 and an outline of the resulting hip structure 182, arches 14, and vaulted apex 12. FIG. 17 illustrates the hip structure 182, arches 14, and vaulted apex 12 with the corner form 182 and air form 90 removed.

Referring first to FIG. 15, a corner structure 180 is formed by a corner form 182 comprising a plurality of rods 116 provide structure to the corner form 182. The rods 116 form an outer skeleton that approximates the ultimate shape of the inner surface of the corner structure 180. The rods 116 are periodically spaced to provide sufficient structural support to the corner structure 180 during construction. As shown, the corner form 182 is configured and placed to lean against a portion of the air form 90. Thus, the air form 90 supports at least a portion of the corner form 182 to prevent the corner form 182 from falling inwardly in the direction of the air form 182. Furthermore, the rounded hip form exterior edge that is restrained by the air form prevents the corner hip roof, and thus entire corner structure from moving in the lateral direction thus giving the entire corner form incredible rigidity and structural strength.

In some embodiments, the corner form 182 includes one or more internal supports or internal supporting structures 184 coupled to rods 116*a* that support a roof portion of the corner structure 180. The internal supporting structure 184 reduces or eliminates bending of these rods 116*a* due to the weight of the concrete during the formation of the corner structure 180. As shown, the internal supporting structure 184 is oriented at an angle with respect to vertical such that its lower portions do not contact the air form 90. Oriented at a non-horizontal angle, the internal supporting structure 184 act as a tripod having just two legs, which support the rods 116*a* that supports the roof portion of the corner structure 180. The internal supporting structure 184 is not a tripod, since one leg would go through the air form 90. Instead, the roof portion is supported by the air form itself to provide complete support to the roof portion of the corner form. In some embodiments, the internal supporting structure 184 includes one or more integrated arch-shaped extension rods or tubes 116*b* coupled to a plurality of vertical supporting rods or tubes 166*c* to which a single layer of wire mesh may be attached. This wire mesh acts to provide lateral support as well as a backing for the sacrificial insulation panels or re-usable solid panels.

As shown in FIG. 16, a layer of concrete and/or another material is applied to the outer surface of the corner form 182 to construct a corner structure 180. At the same time, a layer of concrete and/or another material is applied to the outer surface of the air form 92, forming one or more arches 14. The corner structure 180 and arches 114 form a monolithic building 10 with a vaulted apex 12, as previously described. In some embodiments, the one or more arches 14 are formed when two or more corner structures 180 or other hip structures 20 are included in the building 10. These non-dome-shaped structures can convert the building 10 from a dome (which would be its shape without any hip structures) to one or more arches 10.

FIG. 16 shows the building 10 as transparent to highlight the interface 186 between the corner structure and the arches 14 of the building 10. As shown, the arches 14 extend seamlessly into the corner structure 180 rather than merely butting up against the corner structure 180 at a seam. This extension is shown as a shared (or overlapping) distance 188 in FIG. 16. In other words, the arches 14 and the corner structure 180 are integrally formed as a single structure. Thus, the interface 186 is seamless, since the corner structure 180 and the remainder of the building 10 are formed from a unitary material that is sprayed on or otherwise applied as a unitary layer onto the corner form 182 and air form 90. As a result of this construction process, no seems are present between the corner structure 180 and the arches 14. This translates into a structure that has improved load bearing and load transferring capabilities. More specifically, the corner structure 180 is integrated and formed in a monolithic fashion that allows a transfer of physical loads and lateral/shear restraint from the arches 12 through the corner structure 180. These structural abilities stem, at least in part, from the fact that the arches 12 extend into the corners rather than simply butting against them. The resulting structural strength created from this unitary interface 186 enables the building 10 to be formed of a thinner layer of material and using less reinforcing material.

Figure 18A:
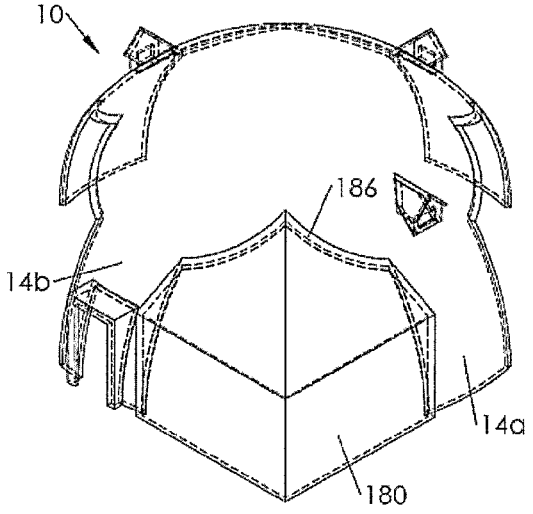
FIG. 18 as shown in parts A-C is a view of the interface between the arched or vaulted portion and hip portion of the structure of FIG. 17 in accordance with a representative embodiment of the present invention.
Figure 18B:
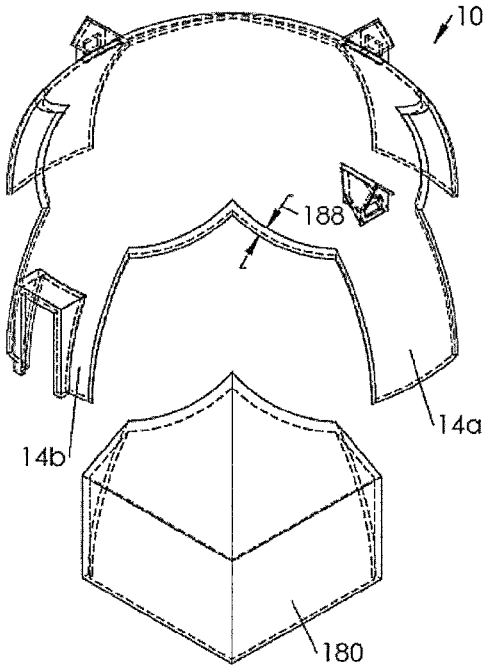
Figure 18C:
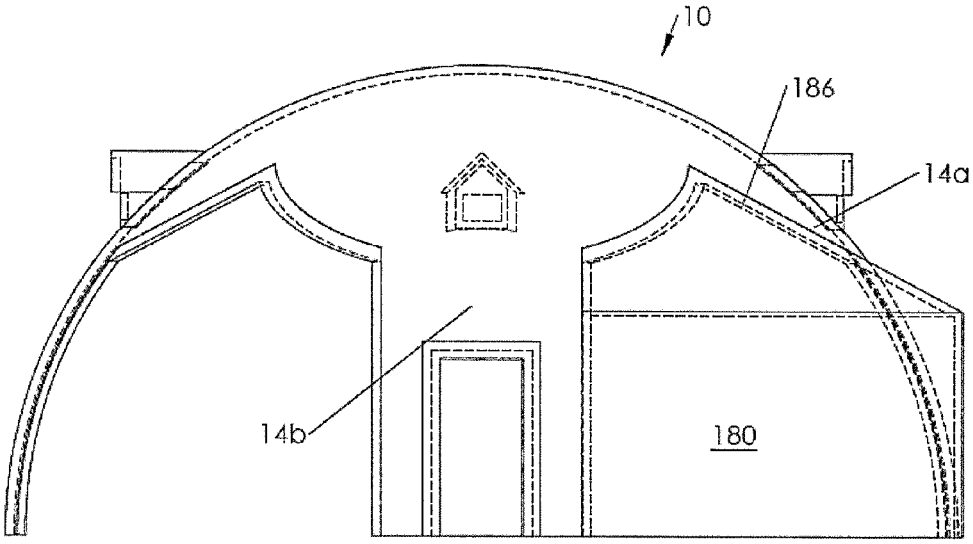

FIG. 17 shows a building 10 formed of two intersecting arches 14 (shown as arch 14*a* and arch 14*b*). While the building includes space for four corner structures 180, three corner structures 180 are removed for the sake of illustration. As shown, the interface 186 between the corner structure 180 and the arches 14*a* and 14*b* is a seamless interface 186 formed by applying one or more layers across the top of the air form 90 and corner form 182 (forms are shown in FIG. 15). FIG. 18A-18C illustrate the nature of this interface 186 by showing a building 10 similar to that of FIG. 17, and then by breaking away the corner structure 182 to reveal the shared distance 188 of the interface 186, or the distance of the corner structure 180 into which the arches 14 extend into the corner structure 180 (or the structure shared by both the arches 14 in the corner structure 180).

It will be noted that a traditional dome has typically been constructed using an air form system with out-structures added in a modular process. This forms a seam between the dome and the out-structure. In contrast, the buildings 10 shown in FIGS. 16 through 18A have a substantial portion (e.g., about 40-70%) of the dome removed. These removals leave two or more bisecting or intersecting arches 14. The bisecting angle of such arches can vary from about 0 to 90. The structural integrity of this arch system can be maintained with the addition of the corner structure 180 (or other hip structure 20, as shown in FIG. 2) in a monolithic process, rather than a modular process. As noted, the monolithic process forms a seamless interface between the arches 14 and the corner structure 180 that allows for a transfer of load and lateral restraints in the building 10.

Reference will now be made to the interior structures of the building 10. In some embodiments, the building can include a plumbing system, even a modular-type plumbing system. In most plumbing applications for home construction the plumbing system is built on site, or in a warehouse for manufactured homes, yet the systems are still built into the home at the time of construction. In some embodiments, a main plumbing tree for building 10 is built offsite. In some embodiments, the plumbing tree is incorporated into an interior wall of the dome building 10, and is configured to accommodate all of the building's underground waste in a single run. This allows for the main "trunk" of the plumbing waste system to be built offsite. In other embodiments, a subsurface plumbing channel is created at a depth, for example 1-2 inches below the top of slab surface, to allow plumbing to be easily installed at a later time.

Above-ground plumbing for building 10 may also be built into a 6", 2 lbs density foam wall. Block-outs are left in the base of the foam wall to "accept" a rubber connector that attaches the wall and plumbing section to the underground tree that would be buried and covered with concrete prior to the wall assembly being attached at the jobsite. In some embodiments, hard plumbing, such as PEX pipe would also be attached at this time and block-outs for these particular attachments would be made at the appropriate locations.

As previously discussed, for some embodiments foundation 70 is screeded using the Plastiform® system or other similar systems. For these embodiments, some will include a system of pre-marked, color coded attachments which will indicate specific locations where to place the underground electrical system in the pre-placed concrete. This conduit system, whether flex or solid, may be built in an offsite facility and coded with coloration that matches the selected slab form system. For some embodiments, the electrical conduit and wires are pre-run and designed to be interchangeable in length and layout. These features allows for ease in installation. A loom will be attached on the end of each wire length (a quick connect loom) that attaches to outlet receptacles around the exterior of the building. For some embodiments, a wireless toggle switch is used in building 10 in an effort to eliminate the difficulty of running conduit for switching lights.

Figure 19:
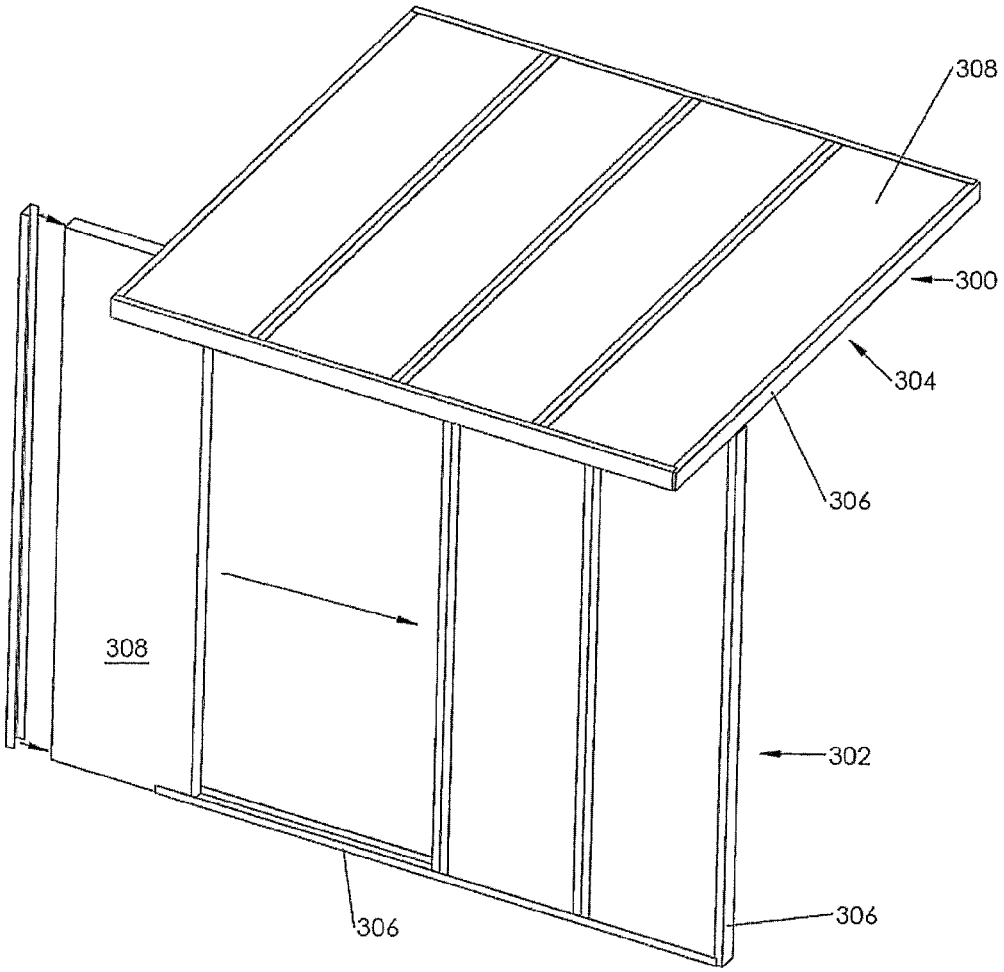
FIG. 19 is a perspective view of a modular wall system during assembly in accordance with a representative embodiment of the present invention.
Figures 20, 21:
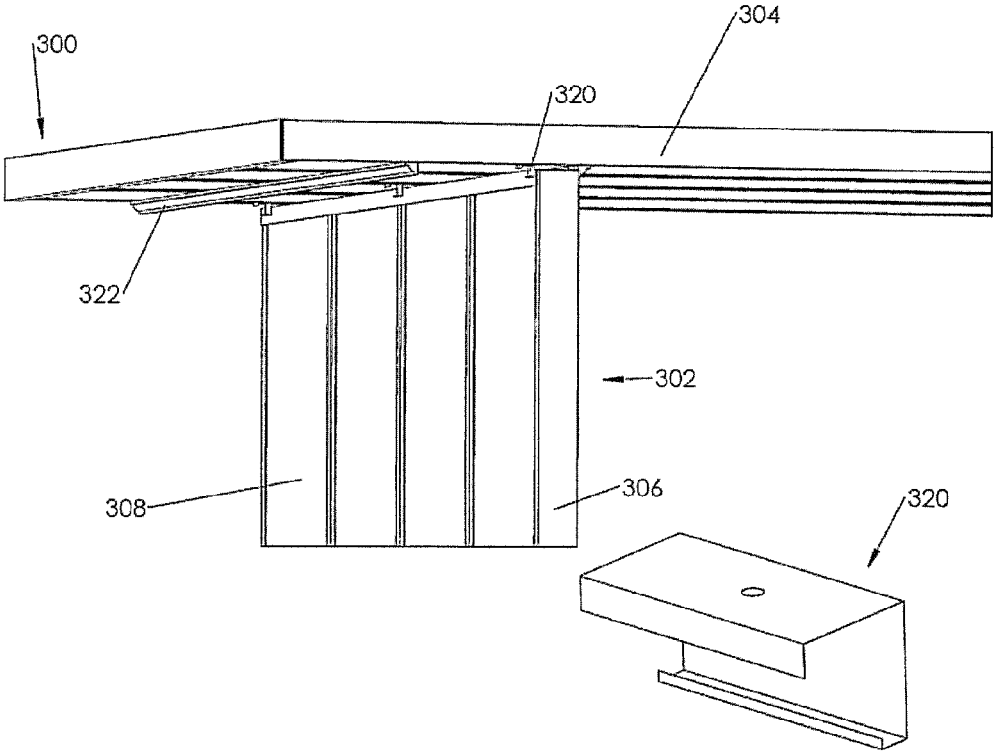
FIG. 20 is a partially exploded, perspective view of the modular wall system of FIG. 19 in accordance with a representative embodiment of the present invention.
FIG. 21 is a perspective view of a clip of the modular wall system in accordance with a representative embodiment of the present invention.

The interior space of monolithic building 10 may be divided by any method known in the art. As shown in FIGS. 19 through 21, in some embodiments, a mobile wall system 300 is provided wherein the interior space of building 10 by be easily adjusted into a one, two, three, four, or more bedroom home, an office space, or even a duplex unit. Since building 10 has a completely structural, integral exterior shell, interior partition walls 302 may be easily and freely moved around the interior of the structure, with exception of the plumbing wall which is a stationary wall. However in cases where the subsurface plumbing channel is employed, all walls can be easily and freely moved so long as one or more walls (or connecting walls) that require plumbing crossover said subsurface plumbing channel.

A movable wall system 300 in accordance with the present invention may include a wall frame built using studs (e.g., metal studs) 306 and track, and panels (e.g., 2 foot by 8 foot panels) 308 inserted between the studs 306. The spacing between metal studs 306 can be approximately 12, 18, 24, 30, 36, or greater than 36 inches. The height of the studs 306 can be approximately 6, 6.5, 7, 7.5, 8, 8.5, 9, 9.5, 10, or more than 10 feet. The panels 308 can have various thicknesses, such as a thickness ranging between 1-12 inches, 1-6 inches, and/or 2-4 inches. The panels 308 can be made of foam or another material. For example, the foam panels 308 can be two pound density expanded polystyrene foam panels. In some embodiments, as shown in FIG. 19, every two feet, two metal studs 306 can be used back to back making an "H" shape channel for retaining the foam panels 308.

In some embodiments, the panels 308 are routed, or a dado is cut in the top, bottom, and side of the panel to run electrical wiring. This wiring then uses standard wiring procedures to fasten gang boxes to the studs and run the wiring. At the end of each wall a special outlet with a male plug is run that will plug into the interior side of the exterior wall receptacle. This allows for the electrical in the movable wall system 300 to become active. In some embodiments, the sturdy foam wall panels are covered with a fire resistant fabric, or a fire retardant elastomeric paint. In some embodiments, the panels are adhered to the floor surface with silicone caulking.

As shown in FIGS. 19 and 20, in some embodiments, a ceiling track system 304 is provided having a similar construction to the interior partition walls 302, discussed above. A ceiling track system 304 may include a stud configuration having a plurality of channels in which to retain panels 308. In some embodiments, the ends of the panels 308 are modified to include dadoes for running electrical circuitry. As such, various ceiling fixtures (such as lights, ceiling fans, fire detectors, etc.) may be changed easily, or moved around to fit various wall arrangements. The 2×8 studs 306 can be used where the ceiling spans of building 10 allow. Where the ceiling span exceeds the capabilities of a 2×4 metal stud, larger studs may be used. As shown in FIGS. 20 and 21, metal tabs 320 are provided on the top tracks to allow the interior partition walls 302 to be fastened to a ceiling track system 304. The metal tab is selectively attached and detached to the ceiling track system 304.

Figure 22A:
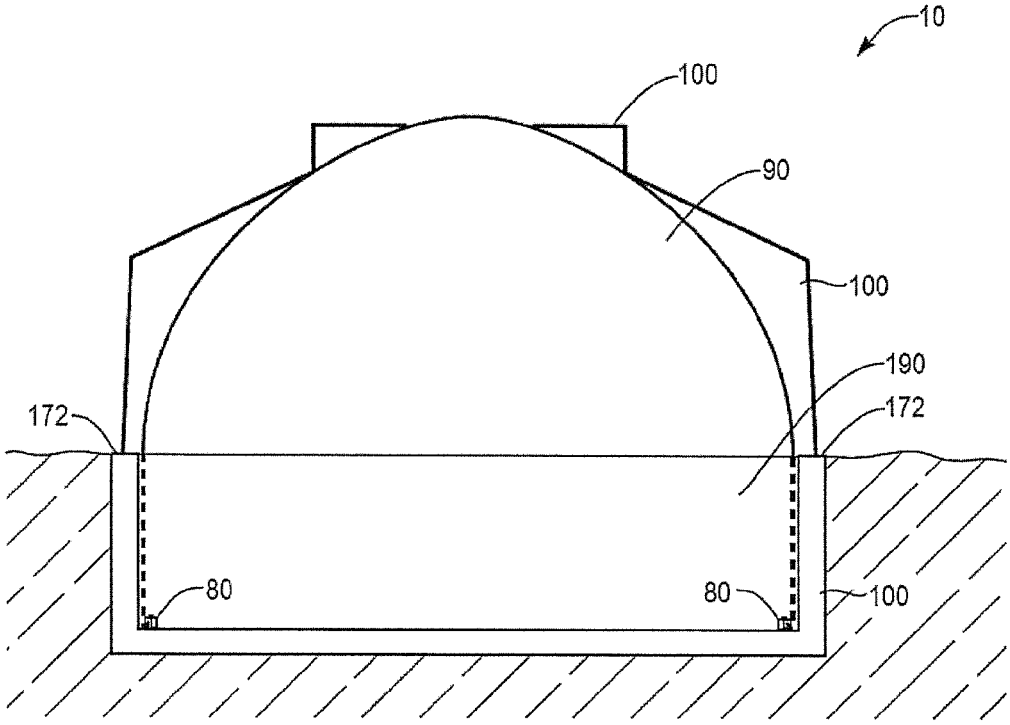
FIG. 22 as shown in parts A and B is an air form or other arch structured form and form extension piece installed in a basement foundation in accordance with a representative embodiment of the present invention.
Figure 22B:
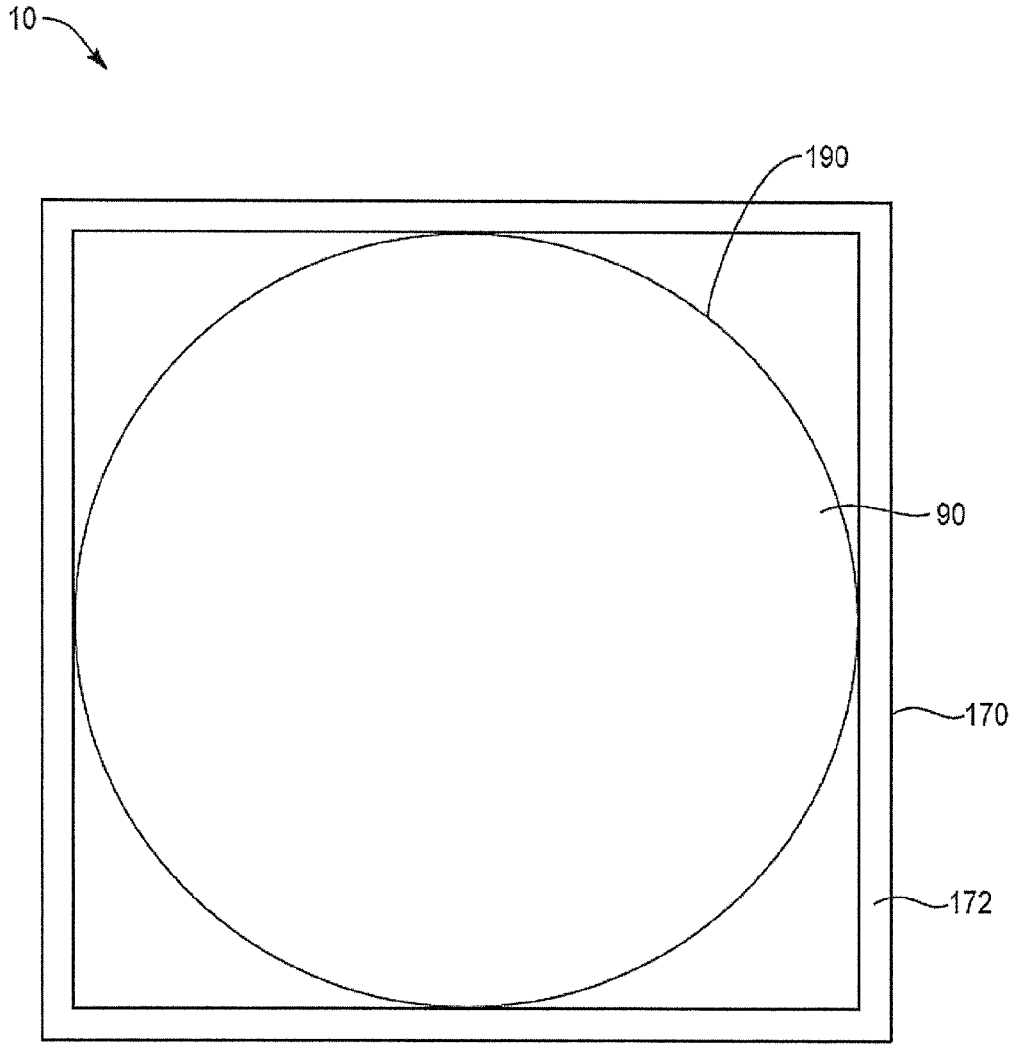
Figure 23:
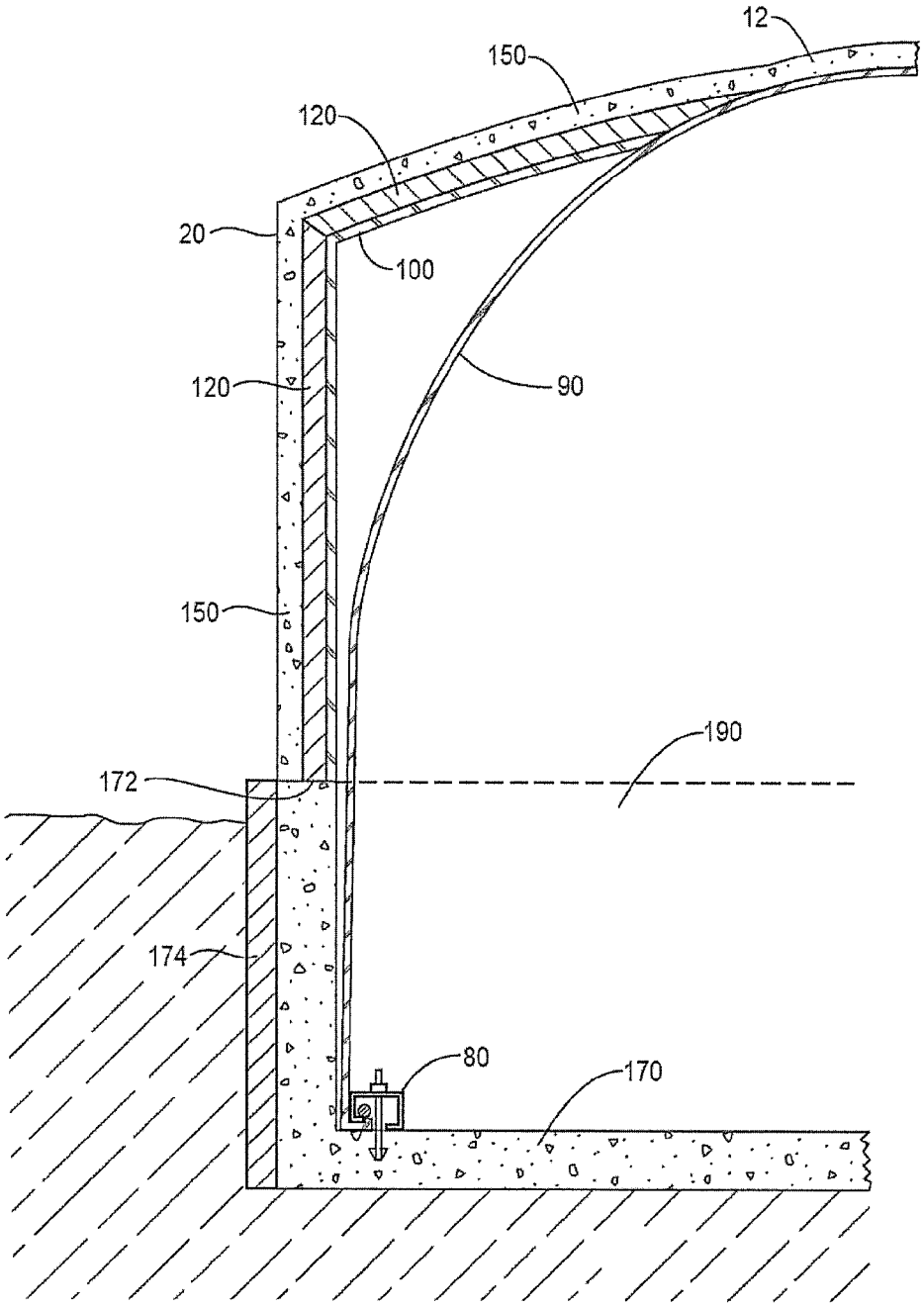
FIG. 23 is a cross-sectional view of a monolithic building set on a basement foundation prior to removal of the various forms of the shoring system in accordance with a representative embodiment of the present invention.

In some embodiments, building 10 further comprises a basement 170, as shown in FIGS. 22A, 22B, and 23. Basement 170 is provided by any known method in the art. Subsequent to providing basement 170, air form 90 is combined with an air form extension piece 190, as shown. Air form extension piece 190 generally comprises a cylindrical air form that extends or lengthens the base of air form 90 such that air form 90 and extension piece 190 are secured to basement 170 by form securing system 80, as discussed previously. Hip forms 100 are applied to air form 90 as previously discussed, wherein the base of hip forms 100 are supported by a surface edge 172 of basement 170, as shown in FIG. 23. In some embodiments, an extruded foam coating 174 is further applied to an outer surface of basement 170, whereby to provide insulation or act as a water barrier.

Figure 24A:
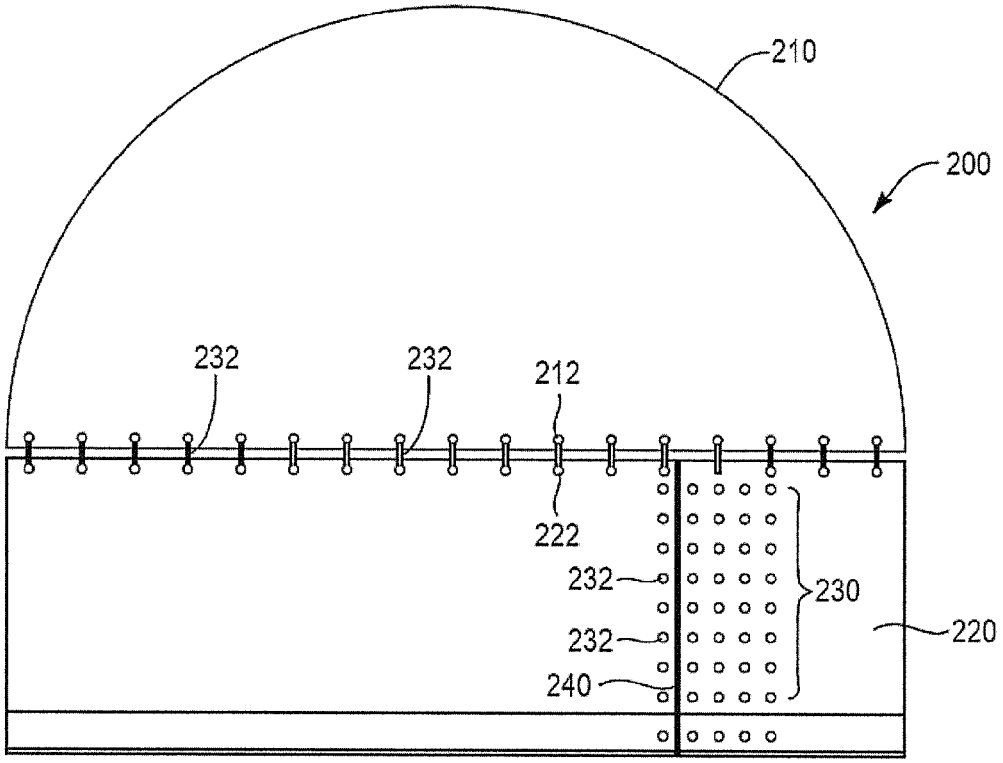
FIG. 24 as shown in parts A and B is a prolate form in accordance with a representative embodiment of the present invention.
Figure 24B:
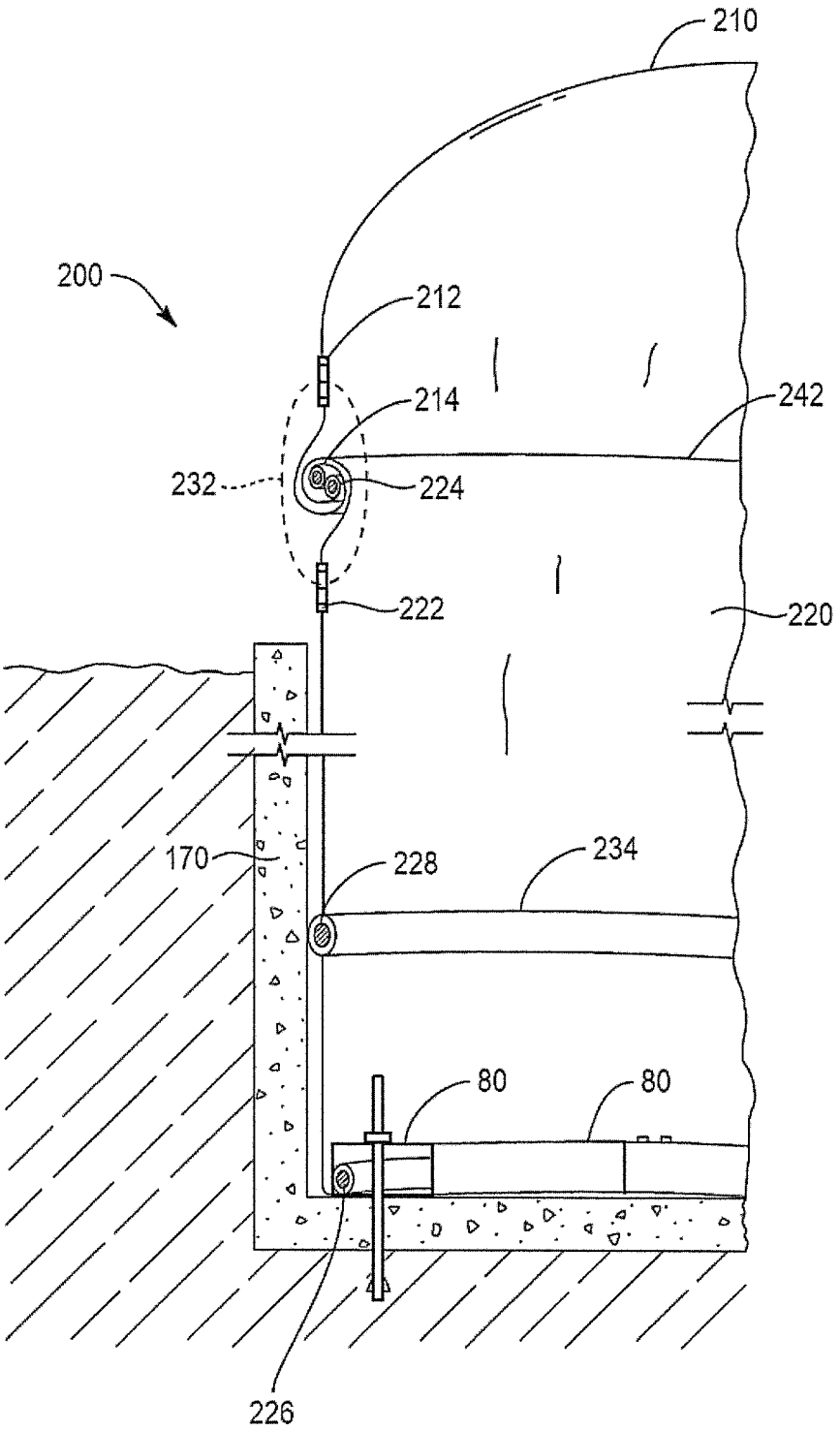

Referring now to FIGS. 24A and 24B, in some embodiments, an adjustable prolate form 200 is provided. Prolate form 200 generally comprises an arched or air form section 210 having a plurality of eyelets or grommets 212 evenly spaced around the form's base perimeter. Prolate form 200 further comprises an extension base form 220 which is generally cylindrical and comprises a plurality of eyelets or grommets 222 which are evenly spaced around the form's perimeter. In some embodiments, grommets 212 and 222 are equally spaced along their respective perimeters thereby permitting the grommets to be aligned. Once aligned, grommets 212 and 222 are fastened together via a fastener 232, such as a zip tie, a piece of rope, or a piece of wire.

In some embodiments, extension base form 220 further comprises a system of adjustable grommets 230 whereby the circumference of base form 220 may be selectively adjusted to match the circumference of air form 210. A desired circumference of base form 220 is maintained by coupling adjustable grommets 230 via a fastener 232. Unused grommets 230 are covered and sealed with an adhesive strip, such as an adhesive tape, thereby providing an airtight base form 220. In some embodiments, the seam 240 is further sealed with an adhesive tape as may be necessary to provide an airtight form.

In some embodiments, air form section 210 is joined to base form 220 by interwrapping base form edge 224 with air form edge 214. In some embodiments, a rope is sewn into edges 224 and 214 to assist in interwrapping the two edges. The interwrapped configuration of the two edges 224 and 214 is maintained by securing a fastener 232 through grommets 212 and 222. An adhesive tape may be further applied to seam 242 and grommets 212 and 222 as necessary to provide an airtight form.

In some embodiments, base form 220 further comprises a rope 226 which is sewn into the base perimeter edge to facilitate securement of form 220 to basement foundation 170 via securing system 80. In other embodiments, base form 220 further comprises a mid-rope 228 which is sewn into a pocket 234. In some embodiments, mid-rope 228 is secured to basement foundation 170 via securing system 80 to compensate for a shallower basement depth. In some embodiments, base form 220 comprises a plurality of mid-ropes to facilitate various basement foundation depths.

Figure 25A:
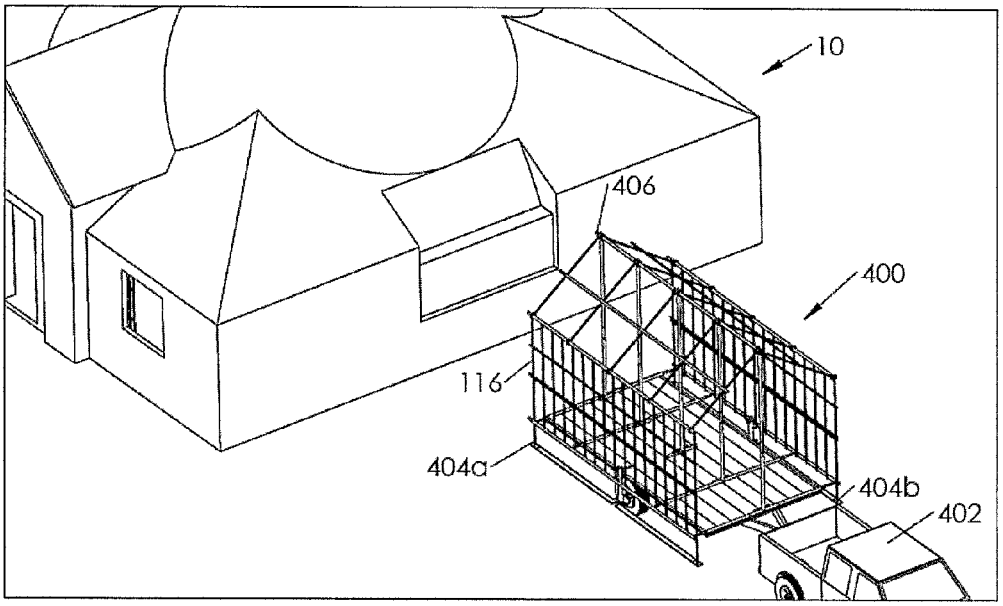
FIG. 25 as shown in parts A through D shows the assembly of a portable hip form in accordance with a representative embodiment of the present invention.

Referring again to the hip form 100 (as previously discussed with reference to FIGS. 8A-9), as shown in FIGS. 25A through 25D, in some embodiments a trailer-based hip form 400 can be used to form a hip structure 20 (as shown in FIGS. 1A-1D), such as a garage for storing a vehicle or other usable space. FIG. 25A shows a trailer-based hip form 400 attached to a vehicle 402. The trailer-based hip form 400 is driven to a construction site and backed into place adjacent a building 10. The trailer-based hip form 400 includes a plurality of retractable and extendable sections (e.g., retractable side sections 404*a* and 404*b* and a retractable roof section 406), with each section including a plurality of rods 116. The rods 116 can be similar to those previously described.

Figure 25B:
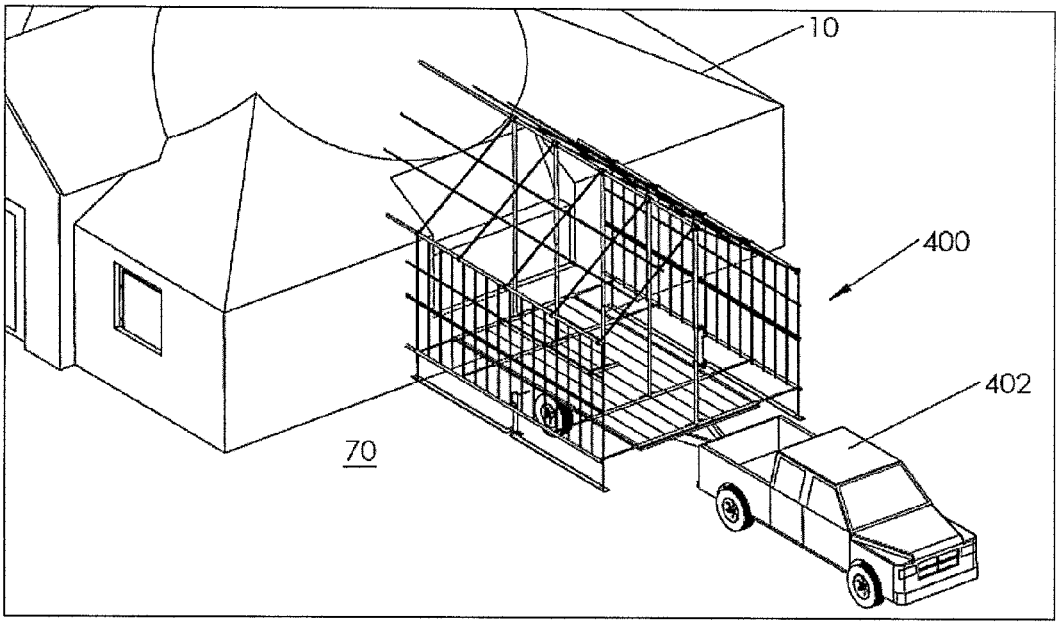

FIG. 25B shows the trailer-based hip form 400 in place adjacent to a building 10. At this point, the extendable sections are extended to extend the trailer-based hip form 400 so that it touches the foundation 70 and the building 10. For example as shown, the extendable side sections 404*a* and 404*b* can be extended downward to touch the foundation 70 or the ground. Additionally, the extendable roof section 406 can extend rearwardly toward the building 10 until it contacts the building 10.

Figure 25C:
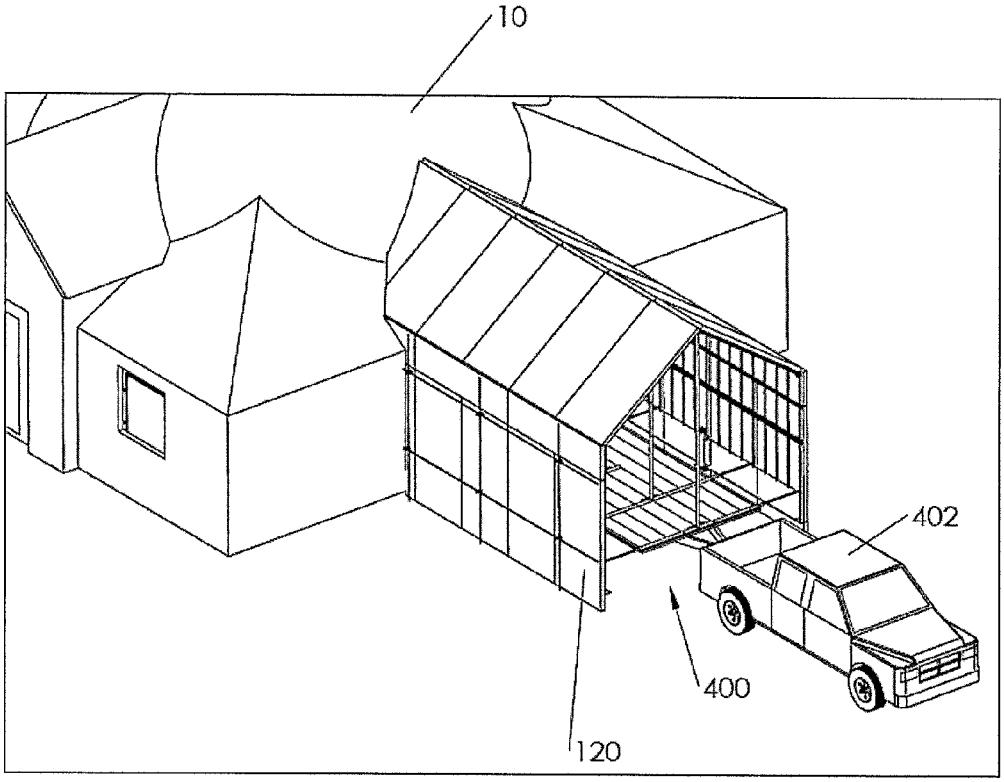
Figure 25D:
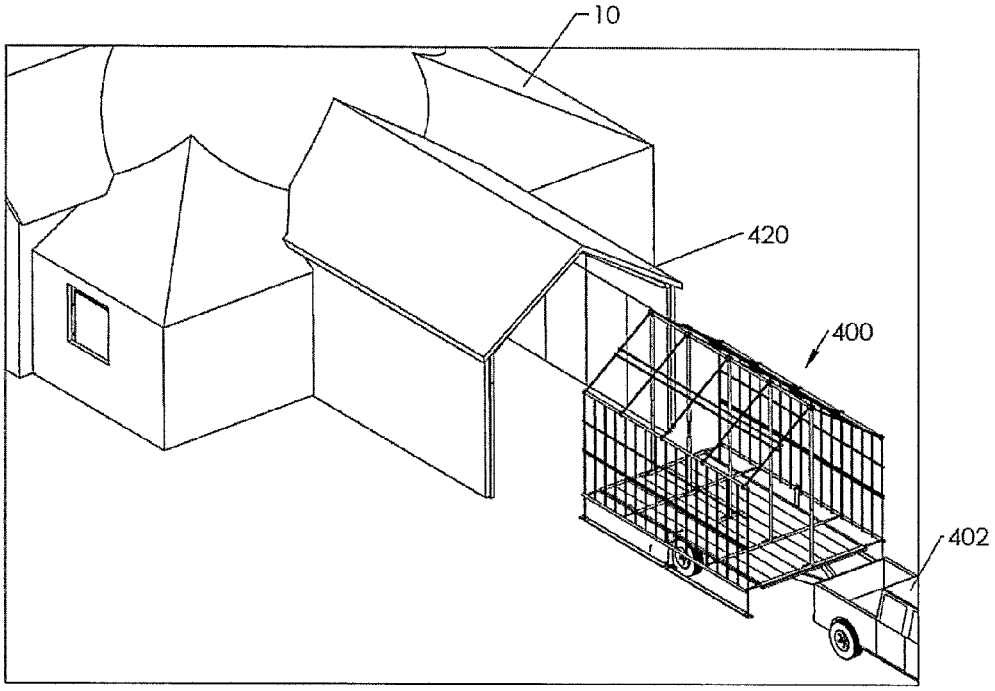

FIG. 25C shows insulating material 120 that has been applied to the trailer-based hip form 400. The insulating material 120 can be applied the same manner as previously described with reference to FIGS. 9 through 15. At this point, the construction of a hip structure 20 can be finalized in the manner previously described. After the hip structures 20 is finalized, the extendable and retractable sections are retracted and the trailer-based hip form 400 is withdrawn from the hip structure 20 and driven away by the towing vehicle 402.

Reference will now be made to FIGS. 26 through 29, which illustrate a scaffolding system that can be used in the construction and/or repair of the monolithic buildings 10 previously described. This scaffolding system is referred to as SPiFolding due to its unique properties, appearance and construction as compared to traditional scaffolding systems. The SPiFolding 500 can be configured with a shape that substantially follows the exterior or interior curvature of the building 10. As such the SPiFolding 500 can generally be disposed within a certain distance from the surface of the building 10. For example, the scaffolding system 500 can always be within, for example, approximately 6, 12, 18, 24, 36, 42, or 48 inches, or another dimension, of the building 10. In a specific embodiment, the scaffolding system 500 can always be within approximately 30 inches of the building 10, therefore not requiring a lot of safety rails since the furthest drop is only 30 inches. By allowing construction workers to move about the SPiFolding, the need for man lifts or other lifting equipment can be reduced or eliminated.

Once assembled, the SPiFolding 500 facilitates the installation of rebar, dormers and other exterior facades, textures, or aesthetic designs. Further, systems and methods provided herein allow for the installation of interior facades, textures, or aesthetic designs. The SPiFolding 500 provides a sturdy and secure platform from which to apply concrete, shotcrete, or another material to the building forms. The SPiFolding 500 allows multiple workers to work on the same building 10 at the same time.

Figure 26:
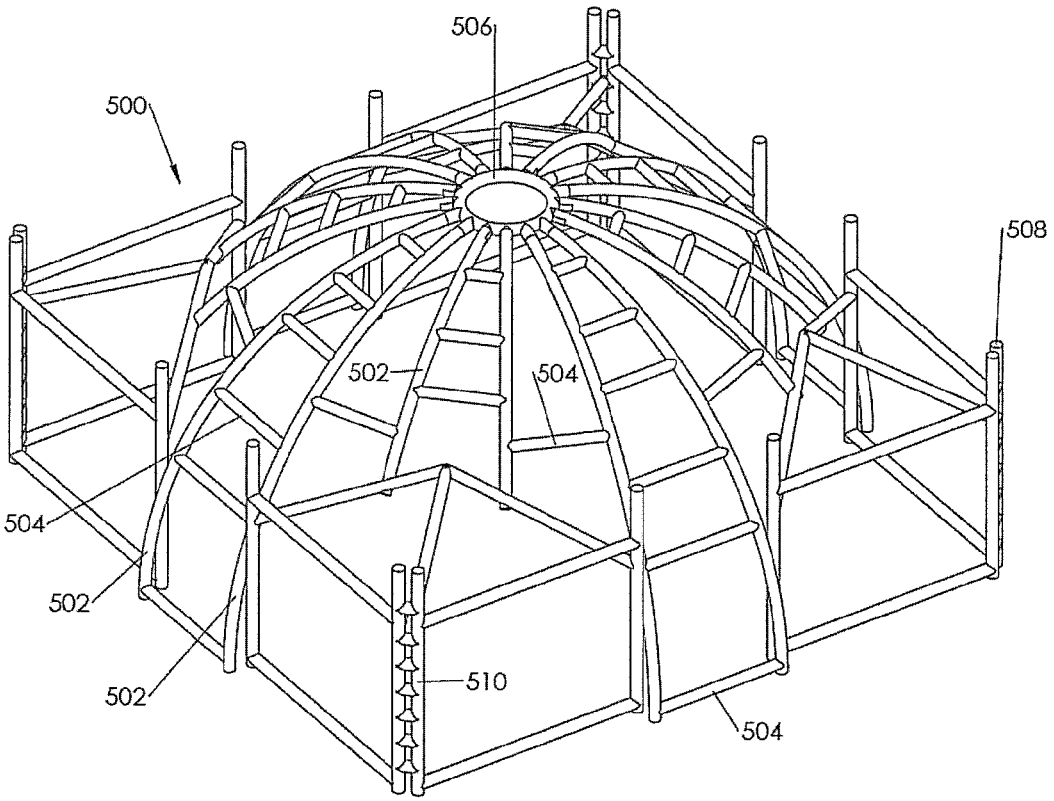
FIG. 26 is a perspective view of a SPiFolding structure in accordance with a representative embodiment of the present invention.

As shown in FIG. 26, the SPiFolding 500 can include a series of arches 502 that can allow a complete span around the building with few or no supports other than on the ground. The SPiFolding 500 includes a set of vertical supports coupled to the arches 500. The vertical supports can be coupled to horizontal supports to form corner scaffolding that surrounds a hip structure 100 of the building 10. A series of horizontal supports 504 can extend horizontally between the arches 502. Additionally, in some embodiments, each of the arches 502 can be coupled to an apex ring 506 at the top of the SPiFolding 500. One or more open posts 508 extend upward from the perimeter of the SPiFolding 500. These posts 508 or another such structure can be configured to receive and couple to safety rails. In some embodiments, the SPiFolding 500 can have a no-bolt design that comprises sleeves and pins to connect all sections of the arches 502 and horizontal supports 504.

Figure 27:
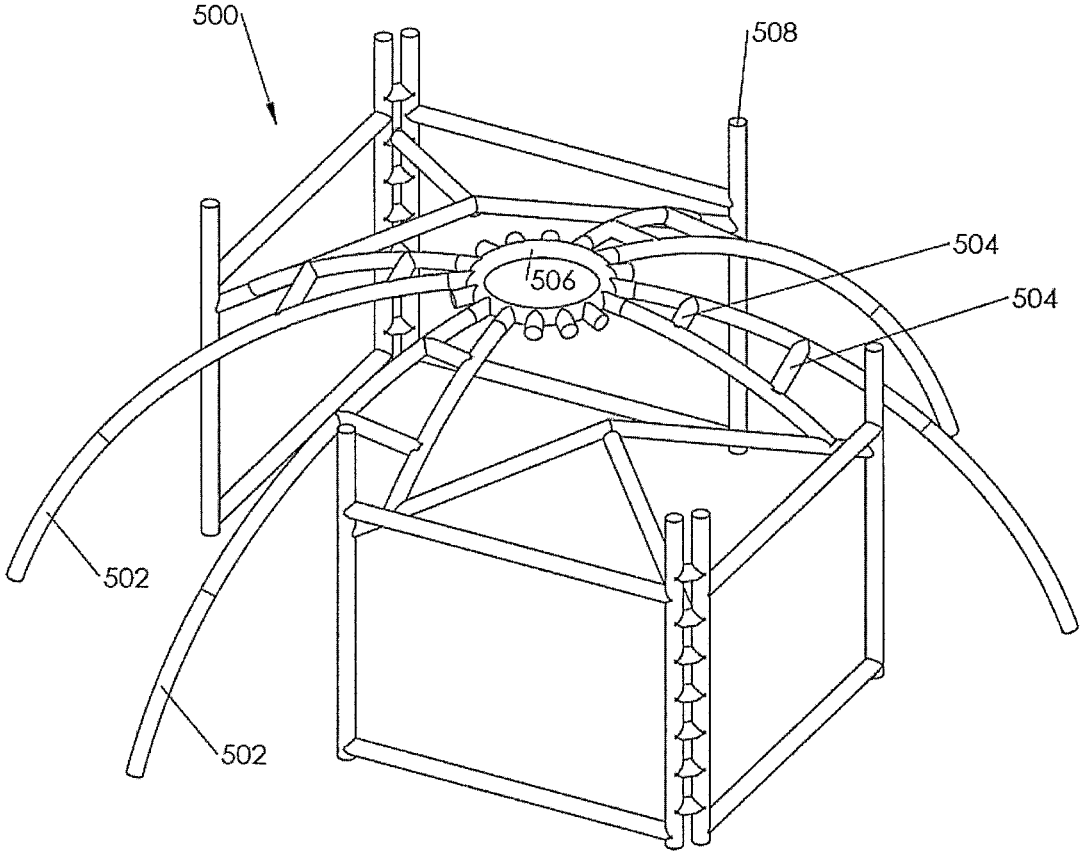
FIG. 27 is a perspective view of another SPiFolding structure in accordance with a representative embodiment of the present invention.
Figure 28:
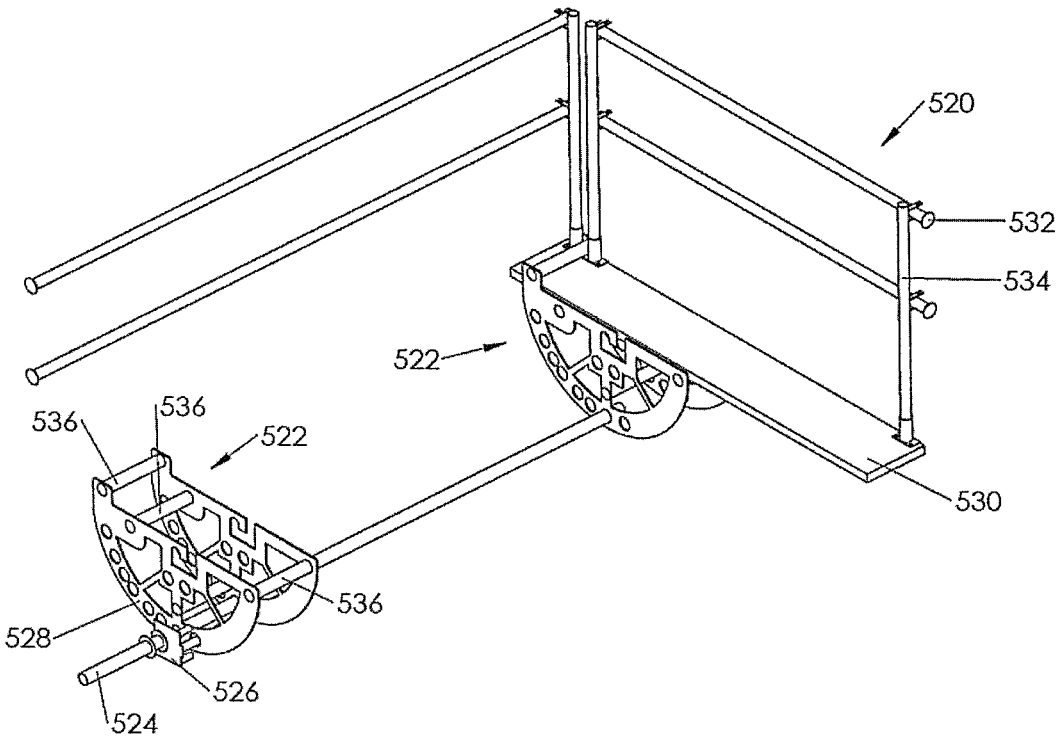
FIG. 28 is a perspective view of a platform for a SPiFolding structure in accordance with a representative embodiment of the present invention.

FIG. 27 illustrates a smaller embodiment of SPiFolding 500 than that shown in FIG. 28. As shown, the SPiFolding 500 can incorporate some or all of the same parts that the SPiFolding 500 of FIG. 26. As such, the SPiFolding 500 can be assembled to fit the size of the building. For example, the arches 502 can include multiple sections, which can be added or removed based on the desired size of the resulting SPiFolding 500.

Figure 29:
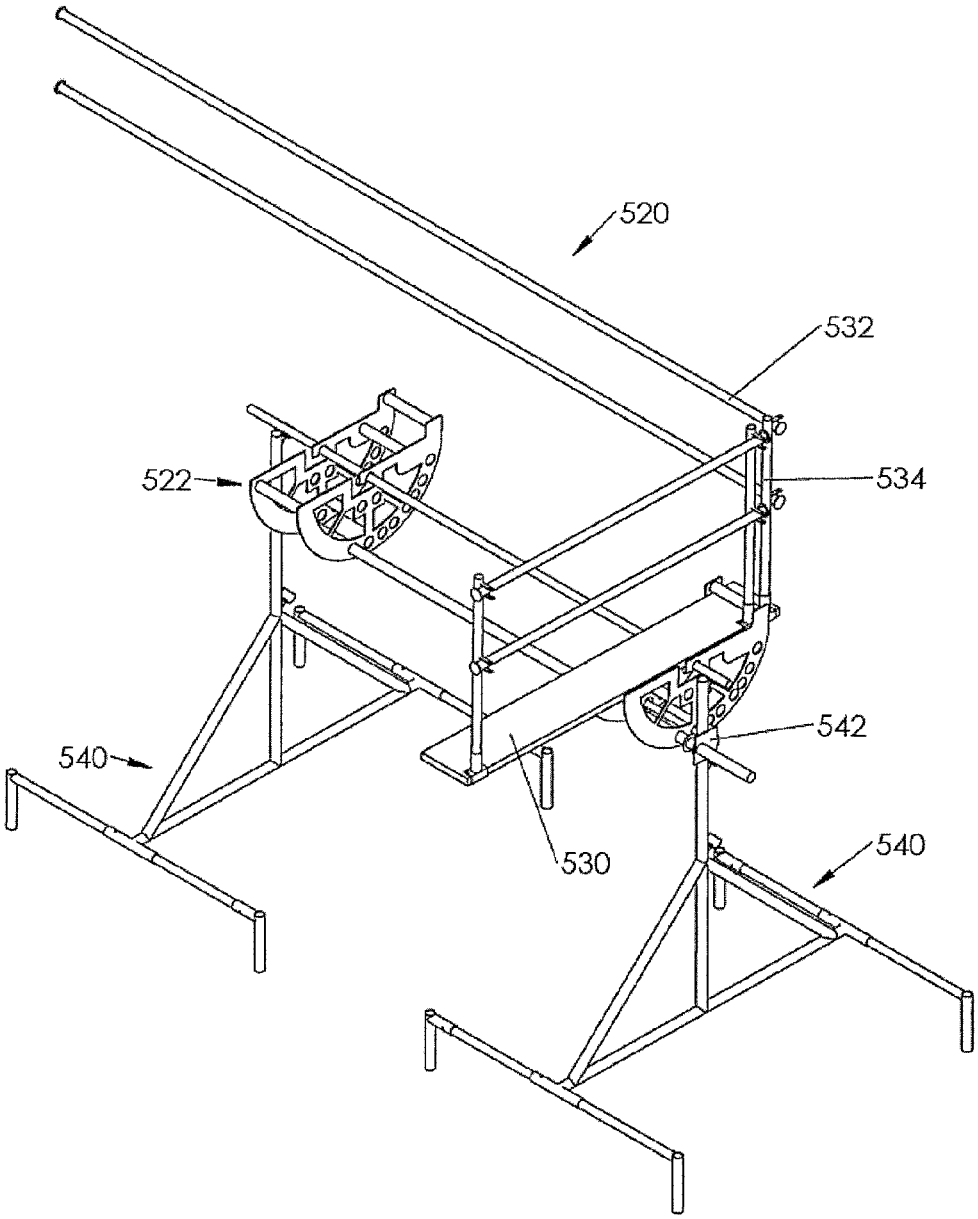
FIG. 29 is a perspective view of the platform of FIG. 28 with a ground bracket for a SPiFolding structure in accordance with a representative embodiment of the present invention.

In some embodiments, the SPiFolding illustrated in FIG. 26 is configured to correspond to and be used in association with the exterior surface of the building, and some of the parts of the SPiFolding can be adjusted or removed to result in a configuration that can be used within the building, such as the configuration shown in FIG. 27, FIGS. 28 and 29 illustrate a platform 520 that can be selectively attached to the SPiFolding 500 of FIGS. 26 and 27. The platform 520 can include one or more leveling devices 522 that support one or more planks 530 in place in a relatively horizontal position. The one or more leveling devices 522 can be configured to adjust the orientation of the plank 530 automatically or manually. As shown, the leveling device 522 includes an arc-shaped member 528 having a plurality of holes therein. The arc-shaped member 528 is coupled to one or more hooks or other attachment members (not shown) that are configured to attach to the horizontal supports of the SPiFolding 500. A locking bar 524 and locking tab 526 can be configured to lock the arc-shaped member 528 in place when one of the locking tabs 526 is inserted into a hole of the arc-shaped member 528. The orientation of the platform 520 can thus be adjusted by moving the locking bar 524 and locking tab 526 so that the locking tab 526 can inserted into another hole of the arc-shaped member 528.

As further shown in FIGS. 28 and 29, the platform 520 includes one or more bars 536 that are configured to hold the plank or planks 536 in place. Moreover, safety rails, which include vertical rails 534 and horizontal rails 532, can be coupled to the platform 520.

Figure 30A:
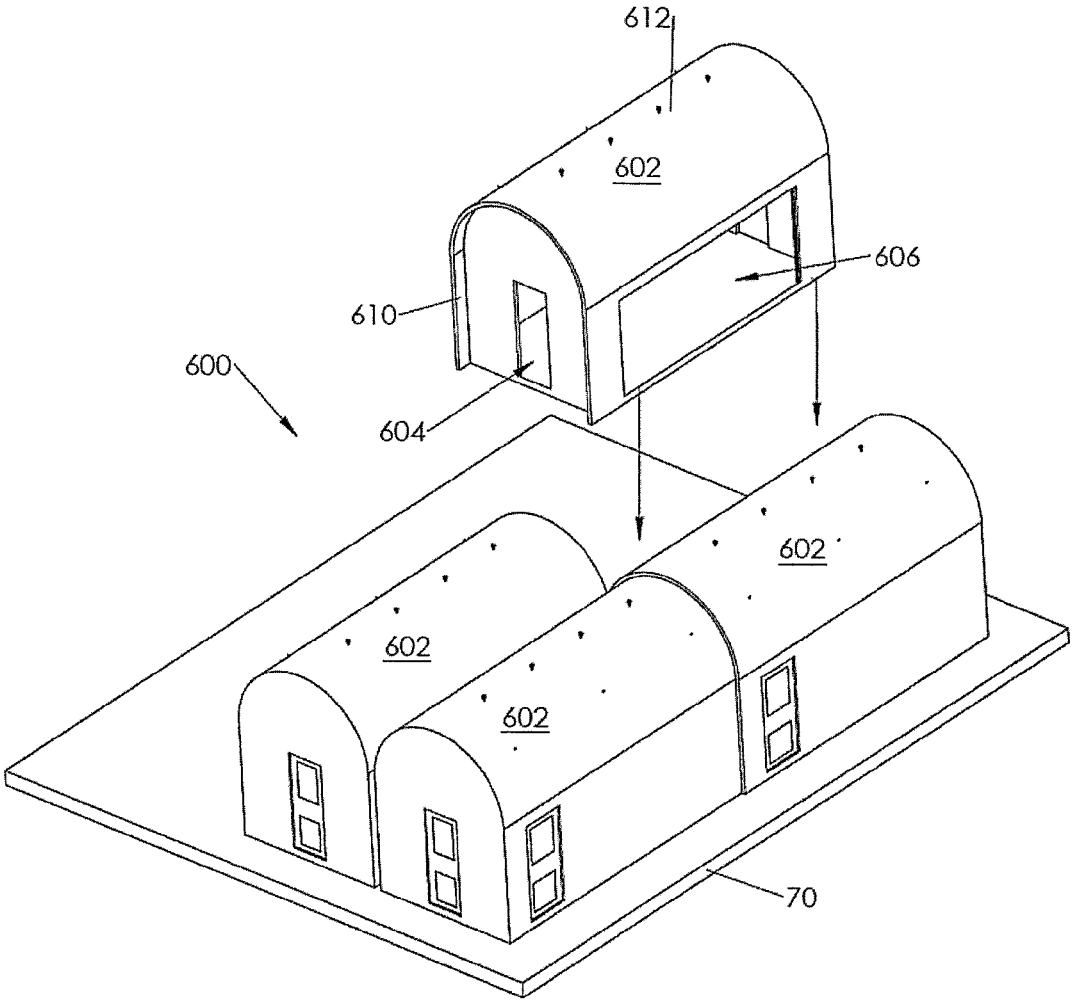
FIG. 30 as shown in parts A through B shows the assembly of modular barracks in accordance with a representative embodiment of the present invention.
Figure 30B:
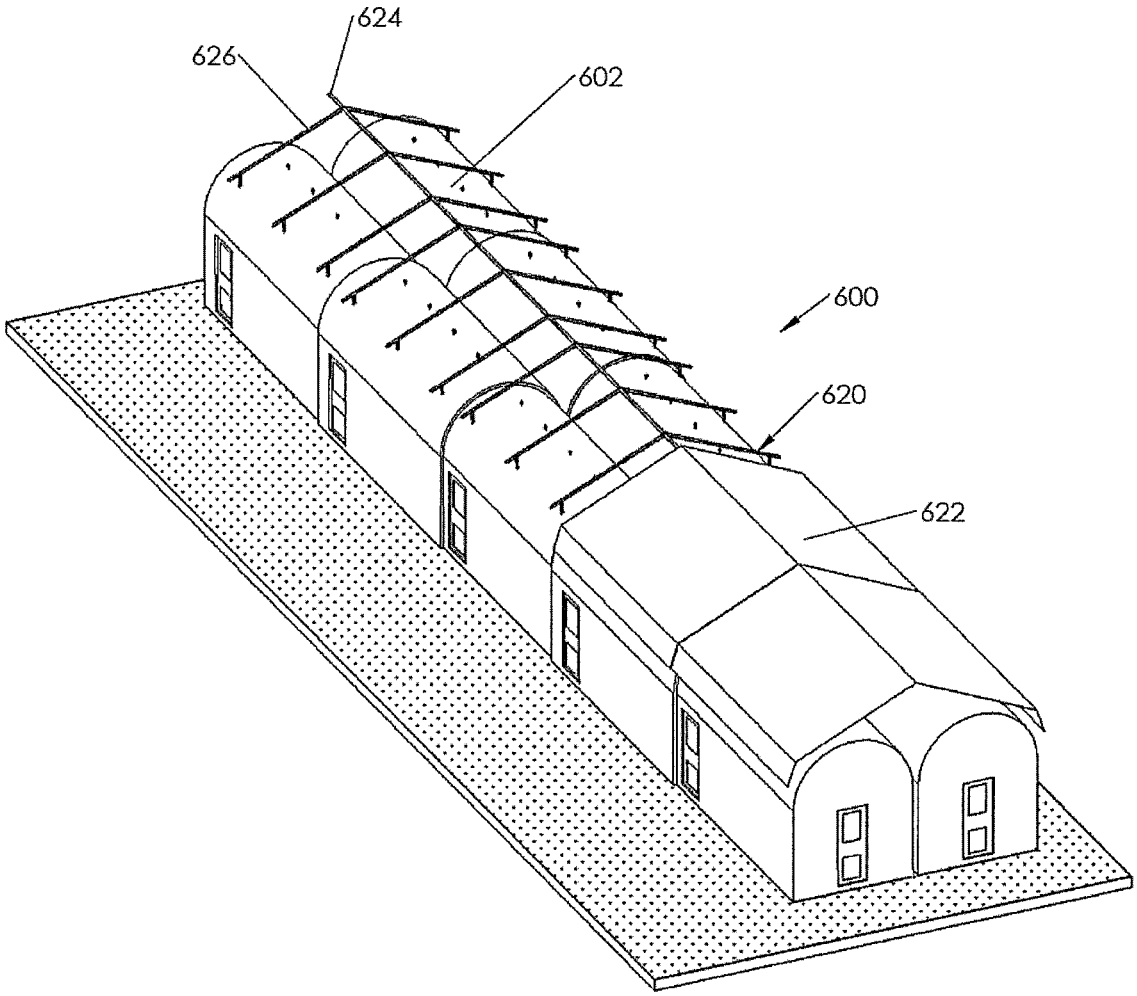

Reference will now be made to FIGS. 30A and 30B, which illustrate modular barracks 600. The modular barracks 600 can be used to form a temporary or permanent building. The modular barracks 600 can include a plurality of modular building units 602. As shown, each modular building units 602 can have a substantially rectangle or base and a semicircular roof 612 to form an upside-down U-shaped side profile. Each modular building unit 602 can also include a floor surface. In some embodiments, each modular building unit 602 can include one or more openings, such as a door opening 604 or other wall opening 606. Wall openings 606 can extend substantially the entire length of the modular building units 602 for only a portion of this distance. Two or more modular building units 602 having wall opening 606 can be placed adjacent to one another such that the wall openings face one another and the two or more modular building units 602 form a larger living space than otherwise possible with a single modular building units 602. Thus, a modular building unit 602 can have an opening in a wall of that is disposed adjacent to a corresponding opening in a wall of an adjacent modular building unit 602.

One or more of the modular building units 602 includes an overlapping portion 610 that includes an extension of the walls and roof outward from one side of the modular building unit 602. The overlapping portion 602 can be placed above and around an adjacent modular building unit 602 to reduce the likelihood of rain, sunshine, or other foreign objects from entering into the modular building unit 602 between two adjacent units.

As shown in FIG. 30A, each modular building unit 602 can be added to existing building units by being lowered in place such that the overlapping portion 602 of the new unit overlaps one of the existing units.

As shown in FIG. 30B, after the module modular building units 602 are in place, a roof structure is placed over the top of all of the units. As shown, the roof structure can include a series of rails supports 620 followed by a canopy member 622. The rail supports 620 are coupled to each modular building unit 602 using one or more fasteners. The rail supports 620 include a central rail that extends the length of the barracks, and support rails 626 thereon perpendicular to the central rail's 24 at an angle. The canopy member 622 includes a flexible member, such as a tarp, canvas, or other water impermeable material. The canopy member 622 includes a rigid member, including a sheet of material, such as would, of metal, or plastic.

At least some embodiments of the present invention result in zero to extremely low amounts of waste material from building such rounded vault forming structures.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A method for providing a monolithic building, the method comprising:

attaching an air form to a surface of a foundation;

inflating the air form;

attaching a non-inflated hip form to an outer surface of the air form; and applying a building material to the outer surface of the air form and an outer surface of the hip form to form a seamless interface between an arched portion and a hip portion of a resulting monolithic building that covers both the air form and the hip form.

2. The method of claim 1, wherein the method further comprises removing a portion of the hip form from the resulting monolithic building such that the resulting monolithic building is supported without the portion of the hip form.

3. The method of claim 1, wherein the hip form comprises a multi-faceted rigid structure that is configured to be removed from the monolithic building.

4. The method of claim 1, further comprising supporting the hip form with an internal supporting structure that is oriented at an angle that runs substantially vertical with respect to the foundation.

5. The method of claim 1, wherein applying the building material to the outer surface of the air form and the outer surface of the hip form further comprises:

applying a structural support material to the outer surface of the air form and the outer surface of the hip form; and applying a cementitious material to an outer surface of the structural support material.

6. The method of claim 5, further comprising inserting a spacer between the structural support material and an insulating material of the building material, the spacer having a fastener to secure the support material with the spacer.

7. The method of claim 1, wherein the hip form comprises a towable trailer having wheels.

8. A monolithic structure device, comprising:

a semi-spherical shell having an inner surface, an outer surface, and an interior volume; and a hip structure having an exterior surface and an interior volume that is integrated with the interior volume of the shell, wherein the integrated hip structure and the semi-spherical shell are joined at an integrated and seamless interface, wherein the outer surface of the shell and the exterior surface of the hip structure were formed by extending a building material over an external surface of both a semi-spherical and inflatable air form and a hip form to create a monolithic structure comprising the integrated hip structure and the semi-spherical shell, wherein the hip form comprises a plurality of external modular pieces that are configured to be removed from the hip form, and wherein a portion of the semi-spherical air form and the hip form has been removed from at least one of the semi-spherical shell and the hip structure such that and the semi-spherical shell and the hip structure are supported without the portion of the semi-spherical air form and the hip form.

9. The device of claim 8, wherein the semi-spherical shell and the hip structure each include an exterior layer of a cementitious material comprising a rebar supporting material.

10. The device of claim 9, wherein the semi-spherical shell and the hip structure each include an inner layer of an insulating material disposed within the exterior layer of cementitious material.

11. The device of claim 8, wherein the integrated monolithic structure device comprises a plurality of integrated hip structures providing the monolithic structure device with a footprint having at least two corners.

12. The device of claim 8, wherein the hip form comprises a trailer having a plurality of wheels.

13. The device of claim 8, wherein the air form comprises a dome-shaped air form coupled to a base cylindrical air form.

14. A system for constructing a monolithic dome building, comprising:

an inflatable air form having an inner surface, an outer surface, and a base surface;

a hip form having an interface surface; and a modular form securing system having multiple interlocking sections in a ring shape, wherein the interlocking sections comprise a channel for coupling the air form, the modular form securing system further having a fastener whereby to secure the modular form securing system to a foundation, wherein the base surface of the air form is configured to be secured to the foundation via the modular form securing system, wherein the interface surface of the hip form is configured to abut the outer surface of the air form to provide a monolithic building form, and wherein an exterior of the monolithic building form is configured to be covered with building material to form a monolithic building that covers both the air form and the hip form.

15. The method of claim 1, wherein the attaching the air form to the surface of the foundation comprises coupling the air form to a plurality of interlocking sections comprising a channel that is configured to retain the air form, and wherein the interlocking sections are interlocked to form a ring.

16. The method of claim 1, further comprising assembling a scaffolding around an exterior portion of the resulting monolithic building, wherein the scaffolding comprises multiple arch-shaped supports connected with a rigid support extending between the arch-shaped supports.

17. A monolithic structure, comprising:

a semi-spherical shell having an inner surface, an outer surface, and an interior volume; and a hip structure having an exterior surface and an interior volume that is integrated with the interior volume of the shell, wherein the integrated hip structure and the semi-spherical shell are joined at an integrated and seamless interface, wherein the outer surface of the shell and the exterior surface of the hip structure extend over an external surface of both a semi-spherical and inflatable air form and a non-inflated, hip form having multiple external surfaces to create a monolithic structure comprising the integrated hip structure and the semi-spherical shell, and wherein at least one of the hip form and the semi-spherical air form are configured to be removable from within the hip structure and the semi-spherical shell.

18. The structure of claim 17, wherein the semi-spherical and inflatable air form comprises an air form section joined to a base form section by interwrapping an edge of the base form section with an edge of the air form section.

19. A method for providing a monolithic building, the method comprising:

attaching an air form to a surface of a foundation;

inflating the air form;

attaching a hip form to an outer surface of the air form; and applying a building material to the outer surface of the air form and an outer surface of the hip form to form a seamless interface between an arched portion and a hip portion of a resulting monolithic building that covers both the air form and the hip form, wherein the hip form comprises a plurality of external modular pieces that are configured to be removed from the hip form.

* * * * *